US012410379B2

(12) United States Patent
Sunahara et al.

(10) Patent No.: US 12,410,379 B2
(45) Date of Patent: Sep. 9, 2025

(54) LUBRICANT OIL COMPOSITION

(71) Applicant: IDEMITSU KOSAN CO., LTD., Chiyoda-ku (JP)

(72) Inventors: Kenji Sunahara, Chiyoda-ku (JP); Shoichiro Fujita, Chiyoda-ku (JP); Masaya Kubota, Chiyoda-ku (JP); Shota Kato, Chiyoda-ku (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/552,717

(22) PCT Filed: Mar. 18, 2022

(86) PCT No.: PCT/JP2022/012548

§ 371 (c)(1),
(2) Date: Sep. 27, 2023

(87) PCT Pub. No.: WO2022/210014

PCT Pub. Date: Oct. 6, 2022

(65) Prior Publication Data

US 2024/0182810 A1 Jun. 6, 2024

(30) Foreign Application Priority Data

Mar. 31, 2021 (JP) ..... 2021-062421

(51) Int. Cl.

| | |
|---|---|
| ***C10M 169/04*** | (2006.01) |
| ***C10M 145/14*** | (2006.01) |
| ***C10M 161/00*** | (2006.01) |
| ***C10N 20/04*** | (2006.01) |
| ***C10N 30/02*** | (2006.01) |
| ***C10N 30/04*** | (2006.01) |
| ***C10N 30/06*** | (2006.01) |
| ***C10N 40/25*** | (2006.01) |

(52) U.S. Cl.

CPC ..... *C10M 169/044* (2013.01); *C10M 145/14* (2013.01); *C10M 161/00* (2013.01); *C10M 2203/003* (2013.01); *C10M 2209/084* (2013.01); *C10M 2215/30* (2013.01); *C10M 2219/044* (2013.01); *C10M 2219/068* (2013.01); *C10M 2223/045* (2013.01); *C10M 2227/061* (2013.01); *C10M 2227/066* (2013.01); *C10N 2020/04* (2013.01); *C10N 2030/02* (2013.01); *C10N 2030/04* (2013.01); *C10N 2030/06* (2013.01); *C10N 2040/255* (2020.05)

(58) Field of Classification Search

CPC ..... C10M 133/44; C10M 135/10; C10M 135/18; C10M 137/10; C10M 139/00; C10M 141/12; C10M 145/14; C10M 161/00; C10M 169/044; C10M 2203/003; C10M 2209/084; C10M 2215/30; C10M 2219/044; C10M 2219/068; C10M 223/045; C10M 2227/061; C10M 2227/066; C10N 2020/04; C10N 2030/02; C10N 2030/04; C10N 2030/06; C10N 2040/255

See application file for complete search history.

(56) References Cited

U.S. PATENT DOCUMENTS

| | | | | | |
|---|---|---|---|---|---|
| 5,851,967 | A * | 12/1998 | Schauber | C10M 145/14 525/303 |
| 2007/0015672 | A1* | 1/2007 | Adams | C10M 163/00 508/460 |
| 2015/0299604 | A1* | 10/2015 | Takata | C10M 145/14 508/503 |
| 2019/0330552 | A1* | 10/2019 | Sumi | C10M 135/18 |

FOREIGN PATENT DOCUMENTS

| | | | |
|---|---|---|---|
| JP | 2004-137317 | A | 5/2004 |
| JP | 2019189668 | A * | 10/2019 |
| JP | 2020-90557 | A | 6/2020 |
| WO | WO 2017/002969 | A1 | 1/2017 |
| WO | WO 2019/203332 | | 10/2019 |

OTHER PUBLICATIONS

English-language machine translation of JP 2019-189668 A (Year: 2019).*

International Search Report and Written Opinion issued May 17, 2022 in PCT/JP2022/012548, 5 pages.

Official communication issued in EP application 22780229.5 on Jan. 15, 2025.

* cited by examiner

*Primary Examiner* — James C Goloboy

(74) *Attorney, Agent, or Firm* — Oblon, McClelland, Maier &Neustadt, L.L.P.

(57) ABSTRACT

A lubricating oil composition, including a base oil (P) and a copolymer (X). The copolymer (X) contains the following structural units (a) to (c): structural unit (a): a structural unit derived from a monomer (A) having a (meth)acryloyl group and a linear or branched alkyl group having 6 to 24 carbon atoms, structural unit (b): a structural unit derived from a monomer (B) having a (meth)acryloyl group and a polar group, and structural unit (c): a structural unit derived from a monomer (C) having a polymerizable functional group and a cyclic structural group. The copolymer (X) has a mass-average molecular weight (Mw) of 5,000 to 50,000, a content of the copolymer (X) in terms of resin content is 0.10% by mass to 2.5% by mass based on the total amount of the lubricating oil composition, and the lubricating oil composition has a 100° C. kinematic viscosity of 8.2 $mm^2/s$ or less.

18 Claims, No Drawings

LUBRICANT OIL COMPOSITION

CROSS REFERENCE TO RELATED APPLICATIONS

This application is a National Stage entry under 35 U.S.C. § 371 of PCT/JP2022/012548, filed on Mar. 18, 2022, and claims priority to Japanese Patent Application No. 2021-062421, filed on Mar. 31, 2021. The entire contents of both are incorporated herein by reference.

TECHNICAL FIELD

The present invention relates to a lubricating oil composition

BACKGROUND ART

In recent years, from the viewpoint of reducing environmental load, improvement in fuel saving performance has been required for vehicles such as automobiles. As one of the methods for improving fuel saving performance, there is known a method in which the viscosity of a lubricating oil composition is reduced to reduce stirring loss and the viscous resistance of an oil film, thereby reducing energy loss (for example, refer to PTL 1).

CITATION LIST

Patent Literature

PTL 1: JP 2004-137317 A

SUMMARY OF INVENTION

Technical Problem

The formation of the oil film is strongly influenced by the viscosity of the lubricating oil composition. If the viscosity is high, the oil film becomes thick, and if the viscosity is low, the oil film becomes thin. As the viscosity is decreased, the shortage of the oil film is more likely to occur, and the boundary lubrication region is increased. Therefore, when the viscosity of the lubricating oil composition is reduced to a degree necessary for reducing fuel consumption, the friction coefficient is increased.

From the viewpoint of ensuring good lubricity, even when the viscosity of the lubricating oil composition is reduced to an extent necessary for reducing fuel consumption, it is desired to maintain a low viscosity without increasing the friction coefficient.

In addition, when the boundary lubrication region is increased, the frequency of direct contact between components (for example, metal components) at the lubricating portion is also increased. Therefore, even if the average value of the friction coefficient of the entire lubricating portion can be maintained low, microscopically, there may be a portion where the friction coefficient is likely to increase and a portion where the friction coefficient is increased. Therefore, when the friction coefficient is measured with a vibration friction and wear tester (SRV tester), the variation in the friction coefficient may be large.

A large variation in the friction coefficient may cause vibration or noise in a mechanism or the like including the components. Therefore, it is desirable to suppress the variation in the friction coefficient as much as possible.

Thus, it is an object of the present invention to provide a lubricating oil composition which can maintain a low friction coefficient while having a low viscosity, and can suppress variation in the friction coefficient.

Solution to Problem

The present inventors have conducted intensive studies in order to solve the above-mentioned problem. As a result, the present inventors have found that a lubricating oil composition containing a copolymer containing a plurality of structural units derived from specific monomers can solve the above-mentioned problem, and have thus accomplished the present invention.

Specifically, the present invention is concerned with the following [1].

[1] A lubricating oil composition containing: a base oil (P); and a copolymer (X), wherein the copolymer (X) contains the following structural units (a) to (c):

- Structural unit (a): a structural unit derived from a monomer (A) having a (meth)acryloyl group and a linear or branched alkyl group having 6 to 24 carbon atoms;
- Structural unit (b): a structural unit derived from a monomer (B) having a (meth)acryloyl group and a polar group;
- Structural unit (c): a structural unit derived from a monomer (C) having a polymerizable functional group and a cyclic structural group; and
- the copolymer (X) has a mass-average molecular weight (Mw) of 5,000 to 50,000;
- a content of the copolymer (X) in terms of resin component is 0.10% by mass to 2.5% by mass based on the total amount of the lubricating oil composition; and
- the lubricating oil composition has a 100° C. kinematic viscosity of 8.2 $mm^2/s$ or less.

Advantageous Effects of Invention

According to the present invention, it is possible to provide a lubricating oil composition which can maintain a low friction coefficient while having a low viscosity, and can suppress variation in the friction coefficient.

DESCRIPTION OF EMBODIMENTS

The upper limit values and the lower limit values of the numerical ranges described herein can be arbitrarily combined. For example, when "A to B" and "C to D" are described as numerical ranges, the numerical ranges of "A to D" and "C to B" are also included in the scope of the present invention.

In addition, a numerical range "lower limit value to upper limit value" described herein means the lower limit value or more and the upper limit value or less, unless otherwise specified.

In addition, in the description herein, the numerical values in Examples are numerical values that can be used as upper limit values or lower limit values.

In the description herein, "(meth)acrylate" means acrylate or methacrylate, and other similar terms have the same meaning.

In the description herein, the term "ring carbon atoms" represents the number of carbon atoms among the atoms constituting the ring itself of a compound having a structure in which atoms are bonded in a ring. When the ring is substituted with a substituent, carbon contained in the substituent is not included in the number of ring carbon atoms.

The same applies to the "ring carbon atoms" described below unless otherwise specified. For example, a benzene ring has 6 ring carbon atoms. Further, when the benzene ring is substituted with, for example, an alkyl group as a substituent, the number of carbon atoms of the alkyl group is not included in the number of ring carbon atoms of the benzene ring. Therefore, the number of ring carbon atoms of the benzene ring substituted with the alkyl group is 6.

In the description herein, the term "ring atoms" represents the number of atoms constituting the ring itself of a compound having a structure in which atoms are bonded in a ring. The number of ring atoms does not include an atom that does not form a ring (for example, a hydrogen atom that terminates a bond between atoms that form a ring) and an atom included in a substituent when the ring is substituted with the substituent. The same applies to the "ring atoms" described below unless otherwise specified. For example, the number of ring atoms of a pyridine ring is 6. In addition, the number of hydrogen atoms bonded to the pyridine ring or the number of atoms constituting the substituent is not included in the number of ring atoms forming the pyridine ring. Therefore, the number of ring atoms of the pyridine ring to which a hydrogen atom or a substituent is bonded is 6.

Aspect of Lubricating Oil Composition

The lubricating oil composition of the present embodiment contains a base oil (P) and a copolymer (X).

The copolymer (X) contains the following structural units (a) to (c).

Structural unit (a): a structural unit derived from a monomer (A) having a (meth)acryloyl group and a linear or branched alkyl group having 6 to 24 carbon atoms.

Structural unit (b): a structural unit derived from a monomer (B) having a (meth)acryloyl group and a polar group.

Structural unit (c): a structural unit derived from a monomer (C) having a polymerizable functional group and a cyclic structural group.

The copolymer (X) has a mass average molecular weight (Mw) of 5,000 to 50,000.

A content of the copolymer (X) in terms of resin component is 0.10% by mass to 2.5% by mass based on the total amount of the lubricating oil composition.

Further, the lubricating oil composition has a 100° C. kinematic viscosity of 8.2 $mm^2/s$ or less.

The present inventors have conducted intensive studies in order to solve the above-mentioned problem. As a result, it has been found that the lubricating oil composition containing the copolymer (X) has a low 100° C. kinematic viscosity of 8.2 $mm^2/s$ or less, but has a low friction coefficient and the variation in the friction coefficient is suppressed.

The reason why the copolymer X) exerts these effects is presumed as follows.

(1) By including the structural unit (a), appropriate oil solubility is ensured.

(2) By including the structural unit (b), a multipoint adsorption type copolymer is obtained.

(3) By including the structural unit (c), an intermolecular interaction occurs due to the cyclic structural group. As a result, when the copolymer (X) is adsorbed to the surfaces of two members facing each other, an appropriate repulsive force is generated between the members, and a friction reducing effect is exhibited.

(4) By adjusting the mass average molecular weight (Mw) of the copolymer (X) within a certain range, the copolymer (X) easily enters between two members facing each other, and the friction reducing effect by the copolymer (X) is sufficiently exhibited.

In the following description, the "base oil (P)" and the "copolymer (X)" are also referred to as a "component (P)" and a "component (X)", respectively.

In the lubricating oil composition according to the present embodiment, the total content of the component (P) and the component (X) is preferably 70% by mass or more, more preferably 75% by mass or more, and still more preferably 80% by mass or more, based on the total amount of the lubricating oil composition.

In the lubricating oil composition according to the present embodiment, the upper limit value of the total content of the component (P) and the component (X) may be adjusted in relation to additives for lubricating oil other than the component (P) and the component (X), and is usually less than 100% by mass, preferably 99% by mass or less, more preferably 97% by mass or less, and still more preferably 95% by mass or less.

The upper limit values and the lower limit values of these numerical ranges can be arbitrarily combined. Specifically, the content is preferably 70% by mass to less than 100% by mass, more preferably 75% by mass to 99% by mass or less, still more preferably 80% by mass to 97% by mass, and even more preferably 80% by mass to 95% by mass.

Hereinafter, each of the components included in the lubricating oil composition according to the present embodiment will be described in detail.

Base Oil (P)

The lubricating oil composition of the present embodiment contains a base oil (P). As the base oil (P), one or more selected from mineral oils and synthetic oils which have been conventionally used as lubricating oil base oils can be used without particular limitation.

Examples of the mineral oil include: an atmospheric residue obtained by atmospheric distillation of a crude oil such as a paraffinic crude oil, an intermediate crude oil, or a naphthenic crude oil; a distillate oil obtained by vacuum distillation of the atmospheric residue; and a mineral oil obtained by subjecting the distillate oil to one or more refining treatments such as solvent deasphalting, solvent extraction, hydrofinishing, hydrocracking, advanced hydrocracking, solvent dewaxing, catalytic dewaxing, and hydroisomerization dewaxing.

Examples of the synthetic oil include poly-α-olefins such as an α-olefin homopolymer and an α-olefin copolymer (for example, α-olefin copolymers having 8 to 14 carbon atoms such as ethylene-α-olefin copolymer); isoparaffins; various esters such as a polyol ester and a dibasic acid ester; various ethers such as a polyphenyl ether; polyalkylene glycols; alkylbenzenes; alkylnaphthalenes; and GTL base oils obtained by isomerizing wax (GTL wax, Gas To Liquids WAX) produced from natural gas by a Fischer-Tropsch method or the like.

The base oil (P) used in the present embodiment is preferably a base oil classified into Group II or III of the base oil category of API (American Petroleum Institute).

As the base oil (P), one selected from the mineral oils may be used alone, or two or more thereof may be used in combination. In addition, one selected from the synthetic oils may be used alone, or two or more thereof may be used in combination. Further, one or more mineral oils and one or more synthetic oils may be used in combination.

With respect to the kinematic viscosity and the viscosity index of the base oil (P), the upper limit is preferably set in the following range from the viewpoint of improving fuel saving performance, and the lower limit is preferably set in the following range from the viewpoint of reducing the loss of the lubricating oil composition due to evaporation and ensuring oil film retention.

The 100° ° C. dynamic viscosity of the base oil (P) is preferably 2.0 $mm^2/s$ to 7.0 $mm^2/s$, more preferably 2.0 $mm^2/s$ to 6.0 $mm^2/s$, and still more preferably 2.0 $mm^2/s$ to 5.0 $mm^2/s$.

The viscosity index of the base oil (P) is preferably 80 or more, more preferably 90 or more, and still more preferably 100 or more.

The 100° C. kinematic viscosity and the viscosity index are values measured or calculated in accordance with JIS K 2283:2000.

In the case where the base oil (P) is a mixed base oil containing two or more base oils, the kinematic viscosity and the viscosity index of the mixed base oil are preferably within the above ranges.

In the lubricating oil composition of the present embodiment, the content of the base oil (P) is not particularly limited, but is preferably 60% by mass or more, more preferably 70% by mass or more, and still more preferably 80% by mass or more, based on the total amount of the lubricating oil composition, from the viewpoint of more easily exhibiting the effects of the present invention. On the other hand, the content is preferably less than 98.5% by mass, more preferably 97% by mass or less, and still more preferably 95% by mass or less. The upper limit values and the lower limit values of these numerical ranges can be arbitrarily combined. Specifically, the content is preferably 60% by mass to less than 98.5% by mass, more preferably 70% by mass to 97% by mass, and still more preferably 80% by mass to 95% by mass.

Copolymer (X)

The copolymer (X) contains the following structural units (a) to (c).

- Structural unit (a): a structural unit derived from a monomer (A) having a (meth)acryloyl group and a linear or branched alkyl group having 6 to 24 carbon atoms.
- Structural unit (b): a structural unit derived from a monomer (B) having a (meth)acryloyl group and a polar group.
- Structural unit (c): a structural unit derived from a monomer (C) having a polymerizable functional group and a cyclic structural group.

In the present embodiment, the copolymer (X) may be composed only of the structural unit (a) derived from the monomer (A), the structural unit (b) derived from the monomer (B), and the structural unit (c) derived from the monomer (C), but may contain other structural units in addition to the structural units (a), (b), and (c) as long as the effects of the present invention are not impaired.

In the present embodiment, the total content of the structural units (a), (b), and (c) in the copolymer (X) is preferably 70 mol % to 100 mol %, more preferably 80 mol % to 100 mol %, and still more preferably 90 mol % to 100 mol %, based on all the structural units of the copolymer (X).

Hereinafter, the monomers (A) to (C) will be described in detail.

Monomer (A), Structural Unit (a)

The monomer (A) used in the present embodiment has a (meth)acryloyl group and a linear or branched alkyl group having 6 or more and 24 or less carbon atoms.

The structural unit (a) derived from the monomer (A) mainly has a function of exhibiting oil solubility (solubility in a mineral oil) in the copolymer (X).

The monomer (A) may be used alone or may be used in combination of two or more thereof. Therefore, the copolymer (X) may include only one type of structural unit (a) derived from the monomer (A), or may include two or more types of structural units (a) derived from the monomer (A).

In the description herein, the monomer (A) is not included in the monomer (B) and the monomer (C). Therefore, the structural unit (a) derived from the monomer (A) is also not included in the structural unit (b) derived from the monomer (B) and the structural unit (c) derived from the monomer (C).

Monomer (A1), Structural Unit (a1)

In the present embodiment, the monomer (A) preferably includes a monomer (A1) represented by the following general formula (a-1) from the viewpoint of more easily exhibiting the effects of the present invention. That is, the structural unit (a) preferably includes a structural unit (a1) derived from the monomer (a1).

(a-1)

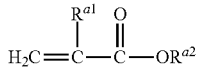

In general formula (a-1), $R^{a1}$ is a hydrogen atom or a methyl group. That is, the monomer (A1) has an acryloyl group or a methacryloyl group as a polymerizable functional group.

It is difficult to obtain a monomer in which $R^{a1}$ is a substituent other than a hydrogen atom and a methyl group, and since the monomer has low reactivity, it is also difficult to polymerize the monomer.

From the viewpoint of easily further improving wear resistance, $R^{a1}$ is preferably a hydrogen atom. That is, the polymerizable functional group of the monomer (A1) is preferably an acryloyl group.

In the general formula (a-1), $R^{a2}$ represents a linear or branched alkyl group having 6 or more and 24 or less carbon atoms.

When the number of carbon atoms of the alkyl group is less than 6 or when the number of carbon atoms of the alkyl group is more than 24, it is difficult to ensure the oil solubility of the copolymer (X).

Examples of the linear alkyl group having 6 or more and 24 or less carbon atoms which may be selected as $R^{a2}$ include a n-hexyl group, a n-octyl group, a n-decyl group, a n-dodecyl group, a n-tetradecyl group, a n-hexadecyl group, a n-octadecyl group, a n-icosyl group, a n-docosyl group, and a n-tetracosyl group.

Examples of the branched alkyl group having 6 to 24 carbon atoms include an isooctyl group, a tert-octyl group, a 2-ethylhexyl group, an isononyl group, an isodecyl group, and an isooctadecyl group.

Here, from the viewpoint of more easily ensuring the oil solubility of the poly(meth)acrylate-based copolymer (X), the number of carbon atoms of the alkyl group is preferably 7 or more, and more preferably 8 or more. On the other hand, the number of carbon atoms of the alkyl group is preferably 22 or less, and more preferably 20 or less.

As the structural unit (a1) derived from the monomer (A1), one type of structural unit may be used alone, or two or more types of structural units may be used in combination.

In the description herein, the monomer (A1) is not included in the monomer (B) and the monomer (C). Therefore, the structural unit (a1) derived from the monomer (A1) is also not included in the structural unit (b) derived from the monomer (B) and the structural unit (c) derived from the monomer (C).

Content of Structural Unit (a1)

In the present embodiment, the content of the structural unit (a1) is preferably 50 mol % to 100 mol %, more preferably 60 mol % to 100 mol %, still more preferably 70 mol % to 100 mol %, even more preferably 80 mol % to 100 mol %, and yet still more preferably 90 mol % to 100 mol %, based on all the structural units of the structural unit (a).

Monomer (B), Structural Unit (b)

The monomer (B) used in the present embodiment has a (meth)acryloyl group and a polar group.

It is presumed that the structural unit (b) derived from the monomer (B) has a function of making the copolymer (X) a multipoint adsorption type copolymer and contributes to improvement of wear resistance.

The monomer (B) may be used alone or may be used in combination of two or more thereof. Therefore, the copolymer (X) may include only one type of structural unit (b) derived from the monomer (B), or may include two or more types of structural units (b) derived from the monomer (B).

In the description herein, the monomer (B) is not included in the monomer (A) and the monomer (C). Therefore, the structural unit (b) derived from the monomer (B) is also not included in the structural unit (a) derived from the monomer (A) and the structural unit (c) derived from the monomer (C).

Monomer (B1), Structural Unit (b1)

In the present embodiment, the monomer (B) preferably includes a monomer (B1) having, as a polar group, one or more groups selected from the group consisting of a nitrogen atom-containing group, a hydroxy group, and a carboxy group, from the viewpoint of more easily exhibiting the effects of the present invention and from the viewpoint of suppressing cloudiness or the like of the lubricating oil composition. That is, the structural unit (b) preferably includes a structural unit (b1) derived from the monomer (B1) having a (meth)acryloyl group and these polar groups.

Monomer having (Meth)acryloyl group and Nitrogen Atom-Containing Group

Examples of the monomer having a (meth)acryloyl group and a nitrogen atom-containing group include amide group-containing acrylic monomers, primary amino group-containing acrylic monomers, secondary amino group-containing acrylic monomers, tertiary amino group-containing acrylic monomers, nitrile group-containing acrylic monomers, urea group-containing acrylic monomers, and urethane group-containing acrylic monomers.

Examples of the amide group-containing acrylic monomer include (meth)acrylamide; monoalkylamino (meth) acrylamides such as N-methyl (meth)acrylamide, N-ethyl (meth)acrylamide, N-isopropyl (meth)acrylamide, N-n-butyl (meth)acrylamide, and N-isobutyl (meth)acrylamide; monoalkylaminoalkyl (meth)acrylamides such as N-methylaminoethyl (meth)acrylamide, N-ethylaminoethyl (meth) acrylamide, N-isopropylamino-n-butyl (meth)acrylamide, N-n-butylamino-n-butyl (meth)acrylamide, and N-isobutylamino-n-butyl (meth)acrylamide; dialkylamino (meth)acrylamides such as N,N-dimethyl (meth)acrylamide, N,N-diethyl (meth)acrylamide, N, N-diisopropyl (meth) acrylamide, and N,N-di-n-butyl (meth)acrylamide; and dialkylaminoalkyl (meth)acrylamides such as N,N-dimethylaminoethyl (meth)acrylamide, N, N-diethylaminoethyl (meth)acrylamide, N, N-dimethylaminopropyl (meth)acrylamide, and N,N-di-n-butylaminobutyl (meth)acrylamide.

Examples of the primary amino group-containing acrylic monomer include aminoalkyl (meth)acrylates having an alkyl group having 2 to 6 carbon atoms, such as aminoethyl (meth)acrylate.

Examples of the secondary amino group-containing acrylic monomer include monoalkylaminoalkyl (meth)acrylates such as tert-butylaminoethyl (meth)acrylate and methylaminoethyl (meth)acrylate.

Examples of the tertiary amino group-containing acrylic monomer include dialkylaminoalkyl (meth)acrylates such as dimethylaminoethyl (meth)acrylate and diethylaminoethyl (meth)acrylate.

Examples of the nitrile group-containing acrylic monomer include (meth)acrylonitrile.

Examples of the urea group-containing acrylic monomer include 2-isocyanatoethyl (meth)acrylate.

Examples of the urethane group-containing acrylic monomer include monofunctional urethane (meth)acrylate.

Monomer having (Meth)acryloyl Group and Hydroxy Group

Examples of the monomer having a (meth)acryloyl group and a hydroxy group include a hydroxy group-containing acrylic monomer.

Examples of the hydroxy group-containing acrylic monomer include hydroxyalkyl (meth)acrylates such as 2-hydroxyethyl (meth)acrylate and 2- or 3-hydroxypropyl (meth) acrylate; and mono- or di-hydroxyalkyl substituted (meth) acrylamides such as N,N-dihydroxymethyl (meth) acrylamide, N,N-dihydroxypropyl (meth)acrylamide, and N,N-di-2-hydroxybutyl (meth)acrylamide.

Monomer having (Meth)acryloyl Group and Carboxy Group

Examples of the monomer having a (meth)acryloyl group and a carboxy group include a carboxy group-containing acrylic monomer.

Examples of the carboxy group-containing acrylic monomer include (meth)acrylic acid; and carboxyalkyl (meth) acrylates such as carboxyethyl (meth)acrylate.

Preferred Acrylic Monomers

Among the acrylic monomers, one or more selected from dialkylaminoalkyl (meth)acrylamide, hydroxyalkyl (meth) acrylate, and carboxyalkyl (meth)acrylate are preferred, and hydroxyalkyl (meth)acrylate is more preferred, from the viewpoint of more easily exhibiting the effects of the present invention.

The number of carbon atoms of the alkyl group included in these monomers is preferably 1 to 6, and more preferably 1 to 4.

As the structural unit (b1) derived from the monomer (B1), one type of structural unit may be used alone, or two or more types of structural units may be used in combination.

In the description herein, the monomer (B1) is not included in the monomer (A) and the monomer (C). Therefore, the structural unit (b1) derived from the monomer (B1) is also not included in the structural unit (a) derived from the monomer (A) and the structural unit (c) derived from the monomer (C).

Content of Structural Unit (b1)

In the present embodiment, the content of the structural unit (b1) is preferably 50 mol % to 100 mol %, more preferably 60 mol % to 100 mol %, still more preferably 70 mol % to 100 mol %, even more preferably 80 mol % to 100 mol %, and yet still more preferably 90 mol % to 100 mol %, based on all the structural units of the structural unit (b).

Monomer (B2), Structural Unit (b2)

In the present embodiment, the content of the structural unit (b2) derived from the monomer (B2) having a polyoxyalkylene group as a polar group is preferably small, from the viewpoint of more easily exhibiting the effects of the present invention, and from the viewpoint of suppressing cloudiness or the like of the lubricating oil composition.

Specifically, the content of the structural unit (b2) derived from the monomer (B2) having a (meth)acryloyl group and a polyoxyalkylene group is preferably less than 5 mol %, more preferably less than 1 mol %, still more preferably less than 0.1 mol % based on all the structural units of the structural unit (b), and most preferably the structural unit (b2) is not contained.

Examples of the monomer (B2) having a (meth)acryloyl group and a polyoxyalkylene group include polyethylene glycol mono(meth)acrylate, polypropylene glycol mono (meth)acrylate, polyethylene glycol monomethyl ether acrylate, and lauryl alcohol-ethyleneoxide adduct (meth)acrylate.

In the polyoxyalkylene group, the number of carbon atoms of the alkylene chain is, for example, 2 or more and 4 or less, and the polymerization degree is 2 or more (for example, 2 to 50).

Monomer (C) having Polymerizable Functional Group and Cyclic Structural Group

The monomer (C) used in the present invention has a polymerizable functional group and a cyclic structural group.

It is presumed that the structural unit (c) derived from the monomer (C) has a function of exhibiting a friction reducing effect in the copolymer (X). Specifically, it is presumed that when the copolymer (X) is adsorbed to the surfaces of two members facing each other, an appropriate repulsive force is generated between the members due to the intermolecular interaction by the cyclic structural group of the structural unit (c), and thus a friction reducing effect is exhibited.

The monomer (C) may be used alone or may be used in combination of two or more thereof. Therefore, the copolymer (X) may include only one type of structural unit (c) derived from the monomer (C), or may include two or more types of structural units (c) derived from the monomer (C).

In the description herein, the monomer (C) is not included in the monomer (A) and the monomer (B). Therefore, the structural unit (c) derived from the monomer (C) is also not included in the structural unit (a) derived from the monomer (A) and the structural unit (b) derived from the monomer (B).

The polymerizable functional group of the monomer (C) is not particularly limited as long as it is capable of forming a copolymer (X) with the monomer (A) and the monomer (B), but is preferably an acryloyl group, a methacryloyl group, or a vinyl group.

From the viewpoint of easily further improving the wear resistance, the polymerizable functional group is preferably an acryloyl group or a methacryloyl group, and more preferably an acryloyl group.

Monomer (C1), Structural Unit (c1)

In the present embodiment, from the viewpoint of more easily exhibiting the effects of the present invention, the monomer (C) preferably includes a monomer (C1) having one or more cyclic structures selected from the group consisting of the following (I) to (III) as the cyclic structure in the cyclic structural group.

(I) Aromatic ring having 6 or more and 14 or less ring carbon atoms.

(II) Alicyclic ring having 3 or more and 14 or less ring carbon atoms.

(III) Heterocyclic ring having 3 or more and 14 or less ring atoms and containing one or more hetero atoms selected from the group consisting of a nitrogen atom and an oxygen atom.

That is, the structural unit (c) preferably includes a structural unit (c1) derived from a monomer (C1) having a polymerizable functional group and one or more cyclic structures selected from the group consisting of the following (I) to (III).

(I) Aromatic Ring Having 6 or More and 14 or Less Ring Carbon Atoms

Examples of the aromatic ring having 6 or more and 14 or less ring carbon atoms include benzene, naphthalene, anthracene, and phenanthrene.

From the viewpoint of more easily exhibiting the effects of the present invention, the number of ring carbon atoms of the aromatic ring is preferably 6 or more and 10 or less. Specifically, the aromatic ring is preferably benzene.

(II) Alicyclic Ring Having 3 or More and 14 or Less Ring Carbon Atoms

Examples of the alicyclic ring having 3 or more and 14 or less ring carbon atoms include a saturated alicyclic ring having a monocyclic structure, such as cyclopropane, cyclobutane, cyclopentane, cyclohexane, cycloheptane, cyclooctane, cyclodecane, and cyclododecane; an unsaturated alicyclic ring having a monocyclic structure, such as cyclopropene, cyclobutene, cyclopentene, cyclohexene, cycloheptene, cyclooctene, cyclodecene, and cyclododecene; a saturated alicyclic ring having a polycyclic structure, such as norbornane and adamantane; and a saturated alicyclic ring having a polycyclic structure, such as norbornene and adamantane.

From the viewpoint of more easily exhibiting the effects of the present invention, the number of ring carbon atoms of the alicyclic ring is preferably 5 or more and 14 or less, and more preferably 5 or more and 10 or less.

Further, from the viewpoint of more easily exhibiting the effects of the present invention, the alicyclic ring is preferably a saturated alicyclic ring having a monocyclic structure or an unsaturated alicyclic ring having a monocyclic structure, and more preferably a saturated alicyclic ring having a monocyclic structure.

Specifically, the alicyclic ring is preferably cyclohexane or cyclohexene, and more preferably cyclohexane.

(III) Heterocyclic Ring Having 3 or More and 14 or Less Ring Atoms and Containing One or More Hetero Atoms Selected from the Group Consisting of a Nitrogen Atom and an Oxygen Atom Examples of the heterocyclic ring having 3 or more and 14 or less ring atoms and containing one or more hetero atoms selected from the group consisting of a nitrogen atom and an oxygen atom, include, as the heterocyclic ring having a monocyclic structure, saturated 3-membered heterocyclic rings such as aziridine, oxirane, diaziridine, oxaziridine, and dioxirane; unsaturated 3-membered heterocyclic rings such as azirine, oxirene, and diazirine; saturated 4-membered heterocyclic rings such as azetidine, oxetane, diazetidine, and dioxetane; unsaturated 4-membered heterocyclic rings such as azeto, oxeto, diazeto, and dioxeto; saturated 5-membered heterocyclic rings such as pyrrolidine, tetrahydrofuran, imidazolidine, pyrazolidine, oxazolidine, isoxazolidine, and dioxolane; unsaturated 5-membered heterocyclic rings such as pyrrole, furan, imidazole, pyrazole, oxazole, isoxazole, triazole, furazane, oxadiazole, dioxazole, tetrazole, oxatetrazole, and pentazole; saturated 6-membered heterocyclic rings such as piperidine, tetrahydropyran, piperazine, morpholine, dioxane, hexahydro-1,3,5-triazine, and trioxane; unsaturated 6-membered heterocyclic rings such as pyridine, pyran, diazine, oxazine, dioxine, triazine, tetrazine, and pentazine; saturated 7-membered heterocyclic rings such as azepane, oxepane, and diazepane; and unsaturated 7-membered heterocyclic rings such as azepine, oxepine, and diazepine.

Examples of the heterocyclic ring having a polycyclic structure include 1H-pyrrolidine, indolizine, isoindole, indole, indazole, purine, 4H-quinolizine, isoquinoline, quinoline, phthalazine, naphthyridine, quinoxaline, quinazoline, cinnoline, pteridine, carbazole, β-carboline, phenanthridine, acridine, perimidine, phenanthroline, phenazine, and phenoxazine.

From the viewpoint of more easily exhibiting the effects of the present invention, the number of ring atoms of the heterocyclic ring is preferably 5 or more and 14 or less, and more preferably 5 or more and 10 or less.

Substituent

The cyclic structures of (I) to (III) above may be unsubstituted or may have a substituent.

The substituent is not particularly limited as long as the effects of the present invention are exhibited, and examples thereof include an organic group having 1 to 30 carbon atoms, and the organic group may have at least one atom of a nitrogen atom and an oxygen atom.

Specific examples thereof include groups selected from the group consisting of an alkyl group having 1 to 30 (preferably 1 to 16, more preferably 1 to 8, and still more preferably 1 to 4) carbon atoms, an alkoxy group having an alkyl group having 1 to 30 (preferably 1 to 16, more preferably 1 to 8, and still more preferably 1 to 4) carbon atoms, an amino group, a cyano group, a nitro group, an alkylcarbonyloxy group having an alkyl group having 1 to 30 (preferably 1 to 16, more preferably 1 to 8, and still more preferably 1 to 4) carbon atoms, a hydroxy group, an alkyl-substituted carbonyl group, and a carboxy group.

The substituent may be further substituted with any of the above-mentioned substituents.

From the viewpoint of more easily exhibiting the effects of the present invention, the cyclic structures of (I) to (III) above are preferably unsubstituted.

Preferred Embodiment of Monomer (C1)

From the viewpoint of more easily exhibiting the effects of the present invention, the monomer (C1) is preferably a monomer represented by the following general formula (c-1).

$$Y\text{-}L^1\text{-}Z \qquad \text{(c-1)}$$

In the general formula (c-1), Y represents a polymerizable functional group, L1 represents a direct bond or a linker, and Z represents a cyclic structural group having any of the cyclic structures of (I) to (III) above.

Examples of the polymerizable functional group which may be selected as Y include an acryloyl group, a methacryloyl group, and a vinyl group. From the viewpoint of easily further improving the wear resistance, the polymerizable functional group is preferably an acryloyl group.

Examples of the linker which may be selected as $L^1$ include a divalent aliphatic hydrocarbon group having 1 to 4 carbon atoms, such as a methylene group, an ethylene group, a n-propylene group, and a n-butylene group; a divalent group having 6 to 10 carbon atoms and having a cyclic structure, such as phenylethylene group and a phenylene group; —O—; an oxyalkylene group (the number of carbon atoms of the alkylene group is preferably 1 to 4); and a polyoxyalkylene group (the number of carbon atoms of the alkylene group is preferably 1 to 4).

Examples of the cyclic structural group which may be selected as Z include a monovalent cyclic structural group obtained by removing one hydrogen atom from any one of the cyclic structures (I) to (III) above. From the viewpoint of easily further improving the wear resistance, the cyclic structural group is preferably a monovalent cyclic structural group obtained by removing one hydrogen atom from the cyclic structure (I) or (II).

In the above (I), an aromatic ring having 6 to 10 ring carbon atoms is preferable.

In the above (II), a saturated alicyclic ring having a monocyclic structure or an unsaturated alicyclic ring having a monocyclic structure is preferable, and a saturated alicyclic ring having a monocyclic structure is more preferable. The number of ring carbon atoms is preferably 6 or more and 10 or less.

Preferred examples of the monomer (C1) include benzyl acrylate, cyclohexyl acrylate, and styrene.

As the structural unit (c1) derived from the monomer (C1), one type of structural unit may be used alone, or two or more types of structural units may be used in combination.

In the description herein, the monomer (C1) is not included in the monomer (A) and the monomer (B). Therefore, the structural unit (c1) derived from the monomer (C1)

is also not included in the structural unit (a) derived from the monomer (A) and the structural unit (b) derived from the monomer (B).

Content of Structural Unit (c1)

In the present embodiment, the content of the structural unit (c1) is preferably 50 mol % to 100 mol %, more preferably 60 mol % to 100 mol %, still more preferably 70 mol % to 100 mol %, even more preferably 80 mol % to 100 mol %, and yet still more preferably 90 mol % to 100 mol %, based on all the structural units of the structural unit (c).

Content of Structural Unit (a)

In the present embodiment, the content of the structural unit (a) derived from the monomer (A) is preferably 43 mol % or more, more preferably 50 mol % or more, and still more preferably 55 mol % or more, based on all the structural units of the copolymer (X), from the viewpoint of more easily exhibiting the effects of the present invention.

On the other hand, from the viewpoint of ensuring the content of the structural unit (b) derived from the monomer (B) and the structural unit (c) derived from the monomer (C) and balancing the content of each structural unit to make it easier to exhibit the effects of the present invention, the content of the structural unit (a) derived from the monomer (A) is preferably 84 mol % or less, more preferably 80 mol % or less, and still more preferably 76 mol % or less, based on all the structural units of the copolymer (X). The upper limit values and the lower limit values of these numerical ranges can be arbitrarily combined. Specifically, it is preferably 43 mol % to 84 mol %, more preferably 50 mol % to 80 mol %, and still more preferably 55 mol % to 76 mol %.

In the description herein, the content ratio of each structural unit in the copolymer (X) usually coincides with the ratio (charging ratio) of each monomer constituting the copolymer (X).

Content of Structural Unit (b)

In the present embodiment, the content of the structural unit (b) derived from the monomer (B) is preferably 9 mol % or more, more preferably 10 mol % or more, and still more preferably 12 mol % or more, based on all the structural units of the copolymer (X), from the viewpoint of more easily exhibiting the effects of the present invention.

On the other hand, from the viewpoint of ensuring the content of the structural unit (a) derived from the monomer (A) and the structural unit (c) derived from the monomer (C) and balancing the content of each structural unit to make it easier to exhibit the effects of the present invention, the content of the structural unit (b) derived from the monomer (B) is preferably 50 mol % or less, more preferably 40 mol % or less, still more preferably 30 mol % or less, and even more preferably 25 mol % or less, based on all the structural units of the copolymer (X). The upper limit values and the lower limit values of these numerical ranges can be arbitrarily combined. Specifically, it is preferably 9 mol % to 50 mol %, more preferably 10 mol % to 40 mol %, and still more preferably 12 mol % to 30 mol %.

Content of Structural Unit (c)

In the present embodiment, the content of the structural unit (c) derived from the monomer (C) is preferably 7 mol % or more, more preferably 8 mol % or more, and still more preferably 10 mol % or more, based on all the structural units of the copolymer (X), from the viewpoint of more easily exhibiting the effects of the present invention.

On the other hand, from the viewpoint of ensuring the content of the structural unit (a) derived from the monomer (A) and the structural unit (b) derived from the monomer (B) and balancing the content of each structural unit to make it easier to exhibit the effects of the present invention, the content of the structural unit (c) derived from the monomer (C) is preferably 30 mol % or less, more preferably 28 mol % or less, still more preferably 26 mol % or less, and even more preferably 25 mol % or less, based on all the structural units of the copolymer (X). The upper limit values and the lower limit values of these numerical ranges can be arbitrarily combined. Specifically, it is preferably 7 mol % to 30 mol %, more preferably 8 mol % to 28 mol %, still more preferably 10 mol % to 26 mol %, and even more preferably 10 mol % to 25 mol %.

Content Ratio of Each Structural Unit

Content Ratio of Structural Unit (b) and Structural Unit (a)

In the copolymer (X) of the present embodiment, from the viewpoint of more easily exhibiting the effects of the present invention, the content ratio [(b)/(a)] of the structural unit (b) and the structural unit (a) is, in terms of molar ratio, preferably 0.15 or more, more preferably 0.20 or more, and still more preferably 0.25 or more, and is preferably 0.50 or less, more preferably 0.45 or less, and still more preferably 0.40 or less. The upper limit values and the lower limit values of these numerical ranges can be arbitrarily combined. Specifically, it is preferably 0.15 to 0.50, more preferably 0.20 to 0.45, and still more preferably 0.25 to 0.40.

Content Ratio of Structural Unit (c) and Structural Unit (a)

In the copolymer (X) of the present embodiment, from the viewpoint of more easily exhibiting the effects of the present invention, the content ratio [(c)/(a)] of the structural unit (c) and the structural unit (a) is, in terms of molar ratio, preferably 0.10 or more, more preferably 0.20 or more, and still more preferably 0.30 or more, and is preferably 0.48 or less, more preferably 0.46 or less, and still more preferably 0.45 or less. The upper limit values and the lower limit values of these numerical ranges can be arbitrarily combined. Specifically, it is preferably 0.10 to 0.48, more preferably 0.20 to 0.46, still more preferably 0.30 to 0.45, and even more preferably 0.30 to 0.45.

Other Monomer

The copolymer (X) may contain a structural unit derived from another monomer in addition to the structural units (a), (b), and (c) as long as the effects of the present invention are not impaired. Examples of the other monomer include a functional group-containing monomer other than the monomers (A), (B), and (C). Examples of the other functional group-containing monomer include functional group-containing (meth)acrylates other than the monomers (A), (B), and (C).

However, from the viewpoint of more easily exhibiting the effects of the present invention, in the copolymer (X), the content of the structural unit derived from the functional group-containing monomer other than the monomers (A), (B), and (C) is preferably less than 30 mol %, more preferably less than 20 mol %, still more preferably less than 10 mol %, even more preferably less than 1 mol %, and yet still more preferably less than 0.1 mol %, based on all the structural units.

Properties and Polymerization Mode of Copolymer (X)

Mass Average Molecular Weight (Mw), Molecular Weight Distribution (Mw/Mn)

The copolymer (X) of the present embodiment is required to have a mass average molecular weight (Mw) of 5,000 to 50,000.

When the mass average molecular weight (Mw) of the copolymer (X) is less than 5,000, it becomes difficult to improve wear resistance.

On the other hand, when the mass average molecular weight (Mw) of the copolymer (X) is more than 50,000, oil solubility may be deteriorated. In addition, it becomes difficult for the copolymer (X) to enter the gap between the two members, and it becomes difficult to exhibit the effect of improving wear resistance.

Here, from the viewpoint of more easily exhibiting the effects of the present invention and from the viewpoint of more easily improving the solubility in the lubricating oil base oil, it is preferably 5,500 or more, more preferably 6,000 or more, still more preferably 7,000 or more, even more preferably 8,000 or more, yet still more preferably 9,000 or more, yet even more preferably 10,000 or more, further more preferably 13,000 or more, further still more preferably 16,000 or more, and further even more preferably 18,000 or more. On the other hand, it is preferably 45,000 or less, more preferably 40,000 or less, and still more preferably 35,000 or less.

The upper limit values and the lower limit values of these numerical ranges can be arbitrarily combined. Specifically, it is preferably 5,500 to 45,000, more preferably 6,000 to 45,000, still more preferably 7,000 to 45,000, even more preferably 8,000 to 45,000, yet still more preferably 9,000 to 45,000, yet even more preferably 10,000 to 45,000, further more preferably 13,000 to 45,000, further still more preferably 16,000 to 40,000, and further even more preferably 18,000 to 35,000.

In addition, the molecular weight distribution (Mw/Mn) of the copolymer (X) of the present embodiment is preferably 1.30 or more, more preferably 1.50 or more, and still more preferably 1.70 or more, from the viewpoint of more easily exhibiting the friction reducing effect. On the other hand, the molecular weight distribution (Mw/Mn) is usually 4.0 or less, preferably 3.0 or less, and more preferably 2.5 or less.

The mass average molecular weight (Mw) and the molecular weight distribution (Mw/Mn) are values measured or calculated by a method described in Examples described below.

Polymerization Mode

The polymerization mode of the copolymer (X) of the present embodiment is not particularly limited, and may be any of block copolymerization, random copolymerization, and block/random copolymerization.

Method for Producing Copolymer (X)

The method for producing the copolymer (X) is not particularly limited, and includes, for example, a step (S) of polymerizing the following monomers (A) to (C) to produce the copolymer (X).

Monomer (A): a monomer having a (meth)acryloyl group and a linear or branched alkyl group having 6 or more and 24 or less carbon atoms.

Monomer (B): a monomer having a (meth)acryloyl group and a polar group.

Monomer (C): a monomer having a polymerizable functional group and a cyclic structural group.

Hereinafter, the step (S) of producing the copolymer (X) will be described in detail.

Step (S) of Producing Copolymer (X)

A production method (polymerization method) of the copolymer (X) is not particularly limited, and the copolymer (X) is produced by applying any of known methods. Examples of such a method include an emulsion polymerization method, a suspension polymerization method, and a solution polymerization method.

Here, from the viewpoint of use of the copolymer (X in the present invention, that is, use as an additive composition for lubricating oil, as a polymerization method, it is preferable to employ a solution polymerization method using a solvent which is dissolved in a lubricating oil base oil as a solvent.

Solution Polymerization Method

The solution polymerization method is carried out, for example, by charging the monomers (A), (B), and (C), a solvent, and an initiator into a reaction vessel, replacing the inside of the reaction vessel with nitrogen, and then stirring and reacting the monomers at 60° C. to 100° C. for 2 hours to 10 hours. In the reaction vessel, other monomers other than the monomers (A), (B), and (C) are also optionally charged.

The solvent used in the solution polymerization method is not particularly limited, and for example, esters such as polyol esters, dibasic acid esters, hindered esters, and monoesters are preferably used.

These may be used alone or may be used in combination of two or more thereof.

Examples of the initiator used in the solution polymerization method include azo-based initiators such as 2,2'-azobis(isobutyronitrile), 2,2'-azobis(2-amidinopropane) dihydrochloride, 2,2'-azobis-(N,N-dimethyleneisobutyramidine) dihydrochloride, 1,1'-azobis(cyclohexyl-1-carbonitrile), and 2,2'-azobis(2,4-dimethylvaleronitrile); organic such peroxides as benzoylperoxide, t-butylhydroperoxide, cumenehydroperoxide, methylethylketoneperoxide, and perbenzoic acid; persulfates such as sodium persulfate, potassium persulfate, and ammonium persulfate; redox initiators of hydrogen peroxide-$Fe^{2+}$; and other existing radical initiators.

Examples of the chain transfer agent used in the solution polymerization method include mercaptans, thiocarboxylic acids, secondary alcohols such as isopropanol, amines such as dibutylamine, hypophosphites such as sodium hypophosphite, chlorine-containing compounds, and alkylbenzene compounds.

The molecular weight of the copolymer (X) is controlled by a known method. For example, the molecular weight of the copolymer (X) can be controlled by a reaction temperature, a reaction time, an amount of an initiator, a charged amount of each monomer, a kind of a solvent, use of a chain transfer agent, and the like.

From the viewpoint of handleability, the copolymer (X) may be diluted with a diluting solvent. As the diluting solvent, it is preferable to use the same solvent as the polymerization solvent.

Charged Amount of Monomer (A)

In the production method of the present embodiment, the charged amount of the monomer (A) is preferably 57% by mass or more, 65% by mass or more, and further preferably 70% by mass or more, based on the total monomers to be charged, from the viewpoint of easily adjusting the content of the above-mentioned structural unit (a). On the other hand, it is preferably 90% by mass or less, more preferably 87% by mass or less, and still more preferably 85% by mass or less.

The upper limit values and the lower limit values of these numerical ranges can be arbitrarily combined. Specifically, it is preferably 57% by mass to 90% by mass or 65% by mass to 87% by mass, and further preferably 70% by mass to 85% by mass.

The compound preferable as the monomer (A) is as described above.

Charged Amount of Monomer (B)

In the production method of the present embodiment, the charged amount of the monomer (B) is preferably 5% by mass or more, more preferably 6% by mass or more, and still more preferably 7% by mass or more, based on the total monomers to be charged, from the viewpoint of easily adjusting the content of the above-mentioned structural unit (b).

On the other hand, it is preferably 38% by mass or less, more preferably 30% by mass or less, still more preferably 20% by mass or less, and even more preferably 15% by mass or less. The upper limit values and the lower limit values of these numerical ranges can be arbitrarily combined. Specifically, it is preferably 5% by mass to 38% by mass, more preferably 6% by mass to 20% by mass, and still more preferably 7% by mass to 15% by mass.

The compound preferable as the monomer (B) is as described above.

Charged Amount of Monomer (C)

In the production method of the present embodiment, the charged amount of the monomer (C) is preferably 5% by mass or more, more preferably 6% by mass or more, and still more preferably 7% by mass or more, based on the total monomers to be charged, from the viewpoint of easily adjusting the content of the above-mentioned structural unit (c).

On the other hand, it is preferably 27% by mass or less, more preferably 23% by mass or less, and still more preferably 20% by mass or less. The upper limit values and the lower limit values of these numerical ranges can be arbitrarily combined. Specifically, it is preferably 5% by mass to 27% by mass, more preferably 6% by mass to 23% by mass, and still more preferably 7% by mass to 20% by mass.

The compound preferable as the monomer (C) is as described above.

Content of Copolymer (X)

In the lubricating oil composition of the present embodiment, the content of the copolymer (X) in terms of resin component is required to be 0.10% by mass to 2.5% by mass based on the total amount of the lubricating oil composition.

When the content of the copolymer (X) in terms of resin component is less than 0.10% by mass, the effects of the present invention are not exhibited. On the other hand, when the content of the copolymer (X) in terms of resin component is more than 2.5% by mass, the effect obtained with respect to the addition amount of the copolymer (X) becomes small.

From the viewpoint of easily exhibiting the effects of the present invention to the maximum with an appropriate addition amount, the content of the copolymer (X) in terms of resin component is preferably 0.15% by mass or more, more preferably 0.20% by mass or more, and is preferably 2.0% by mass or less, more preferably 1.8% by mass or less. The upper limit values and the lower limit values of these numerical ranges can be arbitrarily combined. Specifically, the content is preferably 0.15% by mass to 2.0% by mass, and more preferably 0.20% by mass to 1.8% by mass.

Molybdenum-based Friction Modifier (M)

The lubricating oil composition of the present embodiment preferably further contains a molybdenum-based friction modifier (M). When the lubricating oil composition contains the molybdenum-based friction modifier (M), the friction reducing action can be further improved. In particular, the friction reducing action can be effectively exhibited in an environment in which the temperature of the lubricating oil composition is high.

As the molybdenum-based friction modifier (M), any compound having a molybdenum atom can be used.

Examples of the molybdenum-based friction modifier (M) include molybdenum dithiocarbamate (MoDTC), molybdenum dithiophosphate (MoDTP), and a molybdenum amine complex. These may be used alone or may be used in combination of two or more thereof.

Among these, one or more selected from the group consisting of molybdenum dithiocarbamate (MoDTC) and a molybdenum amine complex are preferable from the viewpoint of obtaining excellent fuel saving performance by reducing an inter-metal friction coefficient.

Examples of the molybdenum dithiocarbamate (MoDTC) include binuclear molybdenum dithiocarbamate containing two molybdenum atoms in one molecule, and trinuclear molybdenum dithiocarbamate containing three molybdenum atoms in one molecule.

That is, in the present embodiment, the molybdenum-based friction modifier (M) preferably includes one or more selected from the group consisting of binuclear molybdenum dithiocarbamate, trinuclear molybdenum dithiocarbamate, and a molybdenum amine complex.

Hereinafter, these molybdenum-based friction modifiers will be described in detail.

Binuclear Molybdenum Dithiocarbamate

Examples of the binuclear molybdenum dithiocarbamate include a compound represented by the following general formula (1) and a compound represented by the following general formula (2).

(1)

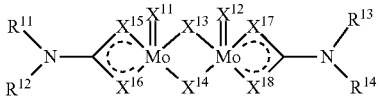

(2)

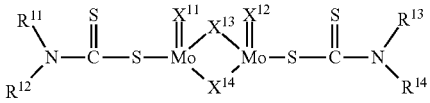

In the general formulae (1) and (2), $R^{11}$ to $R^{14}$ each independently represent a hydrocarbon group, and may be the same as or different from each other.

X11 to X18 each independently represent an oxygen atom or a sulfur atom, and may be the same as or different from each other. Provided that, at least two of X11 to X18 in the formula (1) are each a sulfur atom.

The number of carbon atoms of the hydrocarbon group which may be selected as $R^{11}$ to $R^{14}$ is preferably 6 to 22.

Examples of the hydrocarbon group which may be selected as $R^{11}$ to $R^{14}$ in the general formulae (1) and (2) include an alkyl group, an alkenyl group, a cycloalkyl group, an aryl group, an alkylaryl group, and an arylalkyl group.

Examples of the alkyl group include a hexyl group, a heptyl group, an octyl group, a nonyl group, a decyl group, an undecyl group, a dodecyl group, a tridecyl group, a tetradecyl group, a pentadecyl group, a hexadecyl group, a heptadecyl group, and an octadecyl group.

Examples of the alkenyl group include a hexenyl group, a heptenyl group, an octenyl group, a nonenyl group, a decenyl group, an undecenyl group, a dodecenyl group, a tridecenyl group, a tetradecenyl group, and a pentadecenyl group.

Examples of the cycloalkyl group include a cyclohexyl group, a dimethylcyclohexyl group, an ethylcyclohexyl group, a methylcyclohexylmethyl group, a cyclohexylethyl group, a propylcyclohexyl group, a butylcyclohexyl group, and a heptylcyclohexyl group.

Examples of the aryl group include a phenyl group, a naphthyl group, an anthracenyl group, a biphenyl group, and a terphenyl group.

Examples of the alkylaryl group include a tolyl group, a dimethylphenyl group, a butylphenyl group, a nonylphenyl group, and a dimethylnaphthyl group.

Examples of the arylalkyl group include a methylbenzyl group, a phenylmethyl group, a phenylethyl group, and a diphenylmethyl group.

Among these, molybdenum dialkyldithiocarbamate (M1) represented by the following general formula (m1) (hereinafter, also referred to as "compound (M1)") is preferable.

(m1)

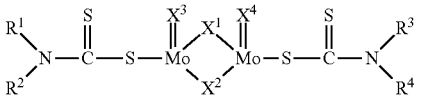

In the general formula (m1), $R^1$, $R^2$, $R^3$, and $R^4$ each independently represent a short-chain substituent group (α) which is an aliphatic hydrocarbon group having 4 to 12 carbon atoms or a long-chain substituent group (β) which is an aliphatic hydrocarbon group having 13 to 22 carbon atoms. Provided that, the molar ratio [(α)/(β)] of the short-chain substituent group (α) to the long-chain substituent group (β) in the total molecule of the compound (M1) is 0.10 to 2.0. Further, in the general formula (b1), $X^1$, $X^2$, $X^3$, and $X^4$ each independently represent an oxygen atom or a sulfur atom.

Examples of the aliphatic hydrocarbon group having 4 to 12 carbon atoms which may be selected as the short-chain substituent group (α) include an alkyl group having 4 to 12 carbon atoms and an alkenyl group having 4 to 12 carbon atoms.

Specific examples thereof include a butyl group, a pentyl group, a hexyl group, a heptyl group, an octyl group, a nonyl group, a decyl group, an undecyl group, a dodecyl group, a butenyl group, a pentenyl group, a hexenyl group, a heptenyl group, an octenyl group, a nonenyl group, a decenyl group, an undecenyl group, and a dodecenyl group. These may be a linear chain or a branched chain.

The number of carbon atoms of the aliphatic hydrocarbon group which may be selected as the short-chain substituent group (α) is preferably 5 to 11, more preferably 6 to 10, and still more preferably 7 to 9, from the viewpoint of more easily exhibiting the effects of the present invention.

Examples of the aliphatic hydrocarbon group having 13 to 22 carbon atoms which may be selected as the long-chain substituent group (β) include an alkyl group having 13 to 22 carbon atoms and an alkenyl group having 13 to 22 carbon atoms.

Specific examples thereof include a tridecyl group, a tetradecyl group, a pentadecyl group, a hexadecyl group, a heptadecyl group, an octadecyl group, a nonadecyl group, an icosyl group, a henicosyl group, a docosyl group, a tridecenyl group, a tetradecenyl group, a pentadecenyl group, a hexadecenyl group, a heptadecenyl group, an octadecenyl group, an oleyl group, a nonadecenyl group, an icosenyl group, a henicosenyl group, and a docosenyl group. These may be a linear chain or a branched chain.

The number of carbon atoms of the aliphatic hydrocarbon group which may be selected as the long-chain substituent group (β) is preferably 13 to 20, more preferably 13 to 16, and still more preferably 13 to 14, from the viewpoint of more easily exhibiting the effects of the present invention.

Here, in the compound (M1) represented by the general formula (m1), the molar ratio [(α)/(β)] of the short-chain substituent group (α) to the long-chain substituent group (β) in the total molecule thereof is 0.10 to 2.0. When the molar ratio [(α)/(β)] is 0.10 or more, the influence of the compound (D3) on the copper-corrosion resistance is reduced, and the friction reducing action is easily improved. When the molar ratio [(α)/(β)] is 2.0 or less, the low-temperature storage stability is easily ensured.

Here, the molar ratio [(α)/(β)] is preferably 0.15 or more, and more preferably 0.20 or more, from the viewpoint of further reducing the influence on the copper corrosion resistance and from the viewpoint of more easily improving the friction reducing action.

On the other hand, the molar ratio [(α)/(β)] is preferably 1.2 or less, more preferably 1.0 or less, still more preferably 0.80 or less, and even more preferably 0.60 or less, from the viewpoint of more easily ensuring the low-temperature storage stability.

The upper limit values and the lower limit values of these numerical ranges can be arbitrarily combined. Specifically, it is preferably 0.15 to 1.2, more preferably 0.20 to 1.0, still more preferably 0.20 to 0.80, and even more preferably 0.20 to 0.60.

Here, the short-chain substituent group (α) and the long-chain substituent group (β) may be present together in the same molecule, or may not be present together in the same molecule. That is, it is only necessary that the mean value of the molar ratio [(α)/(β)] of the short-chain substituent group (α) to the long-chain substituent group (β) in the total molecule of the compound (M1) represented by the general formula (m1) is in the range of 0.10 to 2.0.

Therefore, in the compound (M1), a molecular group (M1-1) in which all of $R^1$, $R^2$, $R^3$, and $R^4$ in the general formula (m1) are the short-chain substituent group (α) may be mixed, a molecular group (M1-2) in which all of $R^1$, $R^2$, $R^3$, and $R^4$ are the long-chain substituent group (β) may be mixed, and a molecular group (M1-3) in which a part of $R^1$, $R^2$, $R^3$, and $R^4$ is the short-chain substituent group (α) and the rest is the long-chain substituent group (β) may be mixed.

Trinuclear Molybdenum Dithiocarbamate

Examples of the trinuclear molybdenum dithiocarbamate include a compound represented by the following general formula (3).

$$Mo_3S_kE_mL_nA_pQ_z \quad (3)$$

In the general formula (3), k is an integer of 1 or more; m is an integer of 0 or more; and (k+m) is an integer of 4 to 10, and preferably an integer of 4 to 7. n is an integer of 1 to 4; and p is an integer of 0 or more. z is an integer of 0 to 5, inclusive of a non-stoichiometric value.

E's are each independently an oxygen atom or a selenium atom, and for example, are one capable of substituting sulfur in a core as mentioned later.

L's are each independently an anionic ligand having a carbon atom-containing organic group; a sum total of carbon atoms of the organic group in each of the ligands is 14 or more; and the respective ligands may be the same as or different from each other.

A's are each independently an anion other than L.

Q's are each independently a neutral compound capable of providing an electron and are existent for the purpose of fulfilling a vacant coordination site on the trinuclear molybdenum compound.

A sum total of carbon atoms of the organic group in the anionic ligand(s) represented by L is preferably 14 to 50, more preferably 16 to 30, and still more preferably 18 to 24.

As L, a monoanionic ligand that is a monovalent anionic ligand is preferred, and specifically, ligands represented by the following general formulae (i) to (iv) are more preferred.

In the general formula (3), the anionic ligand which is selected as L is preferably a ligand represented by the following general formula (iv).

In the general formula (3), it is preferred that all of the anionic ligands which are selected as L are the same, and it is more preferred that all of the anionic ligands selected as L are a ligand represented by the following general formula (iv).

(i)

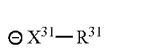

(ii)

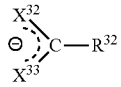

(iii)

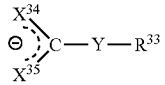

-continued (iv)

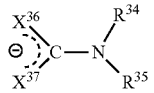

In the general formulae (i) to (iv), X31 to X37 and Y are each independently an oxygen atom or a sulfur atom, and may be the same as or different from each other.

In the general formulae (i) to (iv), $R^{31}$ to $R^{35}$ are each independently an organic group, and may be the same as or different from each other.

The number of carbon atoms of each of the organic groups which may be selected as $R^{31}$, $R^{32}$, and $R^{33}$ is preferably 14 to 50, more preferably 16 to 30, and still more preferably 18 to 24.

The total number of carbon atoms of the two organic groups which may be selected as $R^{34}$ and $R^{35}$ in the formula (iv) is preferably 14 to 50, more preferably 16 to 30, and still more preferably 18 to 24.

The number of carbon atoms of each of the organic groups which may be selected as $R^{34}$ and $R^{35}$ is preferably 7 to 30, more preferably 7 to 20, and still more preferably 8 to 13.

Although the organic group of $R^{34}$ and the organic group of $R^{35}$ may be the same as or different from each other, they are preferably different from each other. In addition, though the number of carbon atoms of the organic group of $R^{34}$ and the number of carbon atoms of the organic group of $R^{35}$ may be the same as or different from each other, they are preferably different from each other.

Examples of the organic group which is selected as $R^{31}$ to $R^{35}$ include a hydrocarbyl group, such as an alkyl group, an aryl group, a substituted aryl group, and an ether group.

The term "hydrocarbyl" expresses a substituent having a carbon atom, which is directly bonded to the residue of the ligand, and in the scope of the present embodiments, characteristics thereof mainly rely on the hydrocarbyl. Examples of such a substituent include the following.

1. Hydrocarbon Substituent

Examples of the hydrocarbon substituent include aliphatic substituents, such as an alkyl group and an alkenyl group; alicyclic substituents, such as a cycloalkyl group and a cycloalkenyl group; and aromatic nuclei substituted with an aromatic group, an aliphatic group, or an alicyclic group; and cyclic groups in which the ring is completed via another site in the ligand (namely, arbitrarily expressed two substituents may each form an alicyclic group).

2. Substituted Hydrocarbon Substituent

Examples of the substituted hydrocarbon substituent include the aforementioned hydrocarbon substituents having, as the substituent, a non-hydrocarbon group which does not change the characteristics of the hydrocarbyl group. Examples of the non-hydrocarbon group include a halogen group, such as a chloro group and a fluoro group, an amino group, an alkoxy group, a mercapto group, an alkyl mercapto group, a nitro group, a nitroso group, and a sulfoxy group.

In the general formula (3), as the anionic ligand which is selected as L, ligands derived from an alkylxanthogenate, a carboxylate, a dialkyldithiocarbamate, or a mixture thereof are preferred, and ligands derived from a dialkyldithiocarbamate are more preferred.

In the general formula (3), the anion which may be selected as A may be either a monovalent anion or a divalent anion, and examples of the anion which may be selected as A include a disulfide, a hydroxide, an alkoxide, an amide, a thiocyanate, and derivatives thereof.

In the general formula (3), examples of Q include water, an amine, an alcohol, an ether, and a phosphine. Although Q's may be the same as or different from each other, they are preferably the same as each other.

As the trinuclear molybdenum dithiocarbamate, a compound represented by the general formula (3) in which k is an integer of 4 to 7; n is 1 or 2; L is a monoanionic ligand; p is an integer of imparting electrical neutrality to the compound based on an anionic charge in A; and m and z are each 0 is preferred; and a compound represented by the general formula (c3-1) in which k is an integer of 4 to 7; L is a monoanionic ligand; n is 4; and p, m, and z are each 0 is more preferred.

As the trinuclear molybdenum dithiocarbamate, for example, a compound having a core represented by the following formula (IV-A) or (IV-B) is preferred. Each core has a net electrical charge of +4. Such a core is surrounded by an anionic ligand and an optionally existing anion other than the anionic ligand.

(IV-A)

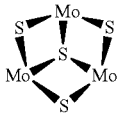

(IV-B)

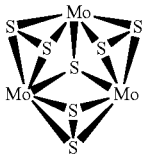

Formation of the trinuclear molybdenum-sulfur compound requires selection of an appropriate anionic ligand (L) and other anion (A), depending on, for example, the number of sulfur and E atoms present in the core, i.e., the total anionic charge constituted of a sulfur atom, an E atom, if present, L, and A, if present, must be−4.

In the case where the anionic charge exceeds 0.4, the trinuclear molybdenum-sulfur compound may also contain a cation other than molybdenum, for example, an (alkyl) ammonium, an amine, or sodium. A preferred embodiment of the anionic ligand (L) and other anion (A) is a constitution having four monoanionic ligands.

The molybdenum-sulfur cores, for example, the structures represented by the aforementioned formulae (IV-A) and (IV-B), may be interconnected by means of one or more multidentate ligands, i.e., a ligand having more than one functional group capable of binding to a molybdenum atom to form oligomers.

The molybdenum content in the trinuclear molybdenum dithiocarbamate is preferably 2.0% by mass or more, more preferably 4.0% by mass or more, and still more preferably 5.0% by mass or more, based on the total amount of the trinuclear molybdenum dithiocarbamate. On the other hand, it is preferably 9.0% by mass or less, more preferably 7.0% by mass or less, and still more preferably 6.0% by mass or less.

The upper limit values and the lower limit values of these numerical ranges can be arbitrarily combined. Specifically, it is preferably 2.0% by mass to 9.0% by mass, more preferably 4.0% by mass to 7.0% by mass, and still more preferably 5.0% by mass to 6.0% by mass.

Molybdenum Amine Complex

Examples of the molybdenum amine complex include molybdenum amine complexes obtained by reacting molybdenum trioxide and/or molybdic acid, which are hexavalent molybdenum compounds, with an amine compound.

Preferred examples of the amine compound include an alkylamine and a dialkylamine.

The alkylamine and dialkylamine to be reacted with the hexavalent molybdenum compound are not particularly limited, and examples thereof include an alkylamine and dialkylamine having an alkyl group having 1 to 30 carbon atoms.

The molybdenum content in the molybdenum amine complex is preferably 4.0% by mass or more, more preferably 6.0% by mass or more, still more preferably 7.0% by mass or more, and is preferably 12.0% by mass or less, more preferably 10.0% by mass or less, still more preferably 9.0% by mass or less, based on the total amount of the molybdenum amine complex.

The upper limit values and the lower limit values of these numerical ranges can be arbitrarily combined. Specifically, it is preferably 4.0% by mass to 12.0% by mass, more preferably 6.0% by mass to 10.0% by mass, and still more preferably 7.0% by mass to 9.0% by mass.

Content of Molybdenum-based Friction Modifier (M)

In the lubricating oil composition of the present embodiment, the content of the molybdenum-based friction modifier (M) is preferably 0.30% by mass or more, more preferably 0.50% by mass or more, and still more preferably 0.70% by mass or more, and is preferably 3.0% by mass or less, more preferably 2.0% by mass or less, and still more preferably 1.0% by mass or less, based on the total amount of the lubricating oil composition, from the viewpoint of reducing the inter-metal friction coefficient to obtain excellent fuel saving performance.

The upper limit values and the lower limit values of these numerical ranges can be arbitrarily combined. Specifically, the content is preferably 0.30% by mass to 3.0% by mass, more preferably 0.50% by mass to 2.0% by mass, and still more preferably 0.70% by mass to 1.0% by mass.

In the lubricating oil composition of the present embodiment, the content of the molybdenum atom derived from the molybdenum-based friction modifier (M) is preferably 0.01% by mass or more, more preferably 0.04% by mass or more, and still more preferably 0.05% by mass or more, based on the total amount of the lubricating oil composition, from the viewpoint of improving the friction reducing action.

On the other hand, the content of the molybdenum atom derived from the molybdenum-based friction modifier (M) is preferably 0.20% by mass or less, more preferably 0.15% by mass or less, and still more preferably 0.12% by mass or less, based on the total amount of the lubricating oil composition, from the viewpoint of reducing the sulfated ash content.

The upper limit values and the lower limit values of these numerical ranges can be arbitrarily combined. Specifically, the content is preferably 0.01% by mass to 0.20% by mass, more preferably 0.04% by mass to 0.15% by mass, and still more preferably 0.05% by mass to 0.12% by mass.

Content Ratio of Binuclear Molybdenum Dithiocarbamate and Trinuclear Molybdenum Dithiocarbamate In the present embodiment, the content ratio of the binuclear molybdenum dithiocarbamate and the trinuclear molybdenum dithiocarbamate [(binuclear MoDTC)/(trinuclear MoDTC)] is preferably 0.1 to 10, more preferably 0.5 to 7.0, and still more preferably 1.0 to 5.0 in terms of mass ratio from the viewpoint of improving the friction reducing action.

Content Ratio of Binuclear Molybdenum Dithiocarbamate and Molybdenum Amine Complex In the present embodiment, the content ratio of the binuclear molybdenum dithiocarbamate and the molybdenum amine complex [(binuclear MoDTC)/(MoAmn)] is preferably 0.1 to 10, more preferably 1.0 to 8.0, and still more preferably 2.0 to 6.0 in terms of mass ratio from the viewpoint of improving the friction reducing action.

Other Components

The lubricating oil composition of the present embodiment may contain other components in addition to the above-described components as necessary, as long as the effects of the present invention are not impaired.

Examples of the additives as the other components include a metal deactivator, a viscosity index improver, a metal-based detergent, a pour point depressant, an antioxidant, an anti-wear agent, a friction modifier other than the molybdenum-based friction modifier (M), an extreme pressure agent, a rust inhibitor, an anti-foaming agent, an oiliness improver, and a demulsifier.

These may be used alone or may be used in combination of two or more thereof.

Metal Deactivator

Examples of the metal deactivator include a benzotriazole-based compound, a tolyltriazole-based compound, a thiadiazole-based compound, an imidazole-based compound, and a pyrimidine-based compound.

These may be used alone or may be used in combination of two or more thereof.

Among these, the lubricating oil composition of the present embodiment preferably contains a benzotriazole-based compound from the viewpoint of improving copper corrosion resistance.

As the benzotriazole-based compound, one or more kinds selected from benzotriazole-based compounds conventionally used as a metal deactivator can be used without particular limitation.

Here, in the present embodiment, from the viewpoint of improving copper corrosion resistance, the benzotriazole-based compound preferably includes a compound (C1) represented by the following general formula (c1).

(c1)

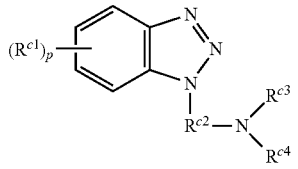

In the general formula (c1), $R^{c1}$ is an alkyl group having 1 to 4 carbon atoms. The alkyl group may be a linear chain or a branched chain. Here, from the viewpoint of improving copper corrosion resistance, the number of carbon atoms of the alkyl group is preferably 1 to 3, more preferably 1 to 2, and still more preferably 1.

In the general formula (c1), p is an integer of 0 to 4. When a plurality of $R^{c1}$'s are present (that is, when p is an integer of 2 to 4), the plurality of Rel's may be the same as or different from each other. Here, from the viewpoint of improving copper corrosion resistance, p is preferably 0 to 3, more preferably 0 to 2, and still more preferably 1.

In the general formula (c1), $R^{c2}$ is a methylene group or an ethylene group. Here, from the viewpoint of improving copper corrosion resistance, $R^{c2}$ is preferably a methylene group.

In the general formula (c1), $R^{c3}$ and $R^{c4}$ are each independently a hydrogen atom or an alkyl group having 1 to 18 carbon atoms. The alkyl group may be a linear chain or a branched chain, but is preferably a branched chain. In addition, the number of carbon atoms of the alkyl group is preferably 2 to 14, more preferably 4 to 12, and still more preferably 6 to 10.

In the lubricating oil composition of the present embodiment, the content of the benzotriazole-based compound is preferably 0.03% by mass or less, more preferably 0.02% by mass or less, and still more preferably 0.015% by mass or less, based on the total amount of the lubricating oil composition, from the viewpoint of further improving the friction reducing action. On the other hand, the content is preferably 0.003% by mass or more, and more preferably 0.005% by mass or more, from the viewpoint of improving copper corrosion resistance. The upper limit values and the lower limit values of these numerical ranges can be arbitrarily combined. Specifically, it is preferably 0.003% by mass to 0.03% by mass, more preferably 0.005% by mass to 0.02% by mass, and still more preferably 0.005% by mass to 0.015% by mass.

Viscosity Index Improver

Examples of the viscosity index improver include polymers such as non-dispersant-type poly(meth)acrylate, dispersant-type poly(meth)acrylate, a comb-shaped polymer, a star polymer, an olefinic copolymer (for example, an ethylene-propylene copolymer), a dispersant-type olefinic copolymer, and a styrene-based copolymer (for example, a styrene-diene copolymer and a styrene-isoprene copolymer).

These may be used alone or may be used in combination of two or more thereof.

Here, from the viewpoint of more easily exhibiting the effects of the present invention, the viscosity index improver is preferably a comb-shaped polymer.

The comb-shaped polymer may be a polymer having a structure in which a main chain has a large number of three way branch points from which a high-molecular-weight side chain extends.

As the comb-shaped polymer, a polymer having at least a structural unit derived from a macromonomer is preferable. The structural unit derived from the macromonomer corresponds to the above-mentioned "high-molecular-weight side chain". The "macromonomer" means a high molecular weight monomer having a polymerizable functional group, and is preferably a high molecular weight monomer having a polymerizable functional group at a terminal.

The number average molecular weight (Mn) of the macromonomer is preferably 300 or more, more preferably 400 or more, and still more preferably 500 or more, and is preferably 100,000 or less, more preferably 50,000 or less, and still more preferably 20,000 or less.

The comb-shaped polymer may be a homopolymer composed only of a structural unit derived from one kind of macromonomer, or may be a copolymer containing structural units derived from two or more kinds of macromonomers. Further, the comb-shaped polymer may be a copolymer containing a structural unit derived from a monomer other than the macromonomer together with a structural unit derived from the macromonomer.

As a specific structure of such a comb-shaped polymer, a copolymer having a side chain containing a structural unit derived from the macromonomer with respect to a main chain containing a structural unit derived from a monomer other than the macromonomer is preferable.

Examples of the monomer other than the macromonomer include alkyl (meth)acrylates, nitrogen atom-containing vinyl monomers, hydroxy group-containing vinyl monomers, phosphorus atom-containing monomers, aliphatic hydrocarbon-based vinyl monomers, alicyclic hydrocarbon-based vinyl monomers, vinyl esters, vinyl ethers, vinyl ketones, epoxy group-containing vinyl monomers, halogen element-containing vinyl monomers, esters of unsaturated polycarboxylic acids, (di)alkyl fumarates, (di)alkyl maleates, and aromatic hydrocarbon-based vinyl monomers.

The mass average molecular weight (Mw) of the comb-shaped polymer is preferably 100,000 to 1,000,000, more preferably 200,000 to 800,000, and still more preferably 250,000 to 750,000.

The molecular weight distribution (Mw/Mn) of the comb-shaped polymer is preferably 8.00 or less, more preferably 7.00 or less, still more preferably 6.00 or less, and even more preferably 3.00 or less, and usually 1.01 or more, preferably 1.05 or more, and still more preferably 1.10 or more.

The PSSI (permanent shear stability index) of the comb-shaped polymer is preferably 12.0 or less, more preferably 10.0 or less, still more preferably 5.0 or less, even more preferably 3.0 or less, and yet still more preferably 1.0 or less.

The lower limit of the PSSI of the comb-shaped polymer is not particularly limited, but is usually 0.1 or more, and preferably 0.2 or more.

In the description herein, the PSSI (permanent shear stability index) of the viscosity index improver indicates a decrease in viscosity due to shearing derived from the resin component in the viscosity index improver as a percentage, and is a value calculated in accordance with ASTM D 6022-06. More specifically, the PSSI is a value calculated by the following calculation formula.

$$PSSI = \frac{K_{V0} - K_{V1}}{K_{V0} - K_{Voil}} \times 100$$

In the above calculation formula, $Kv_0$ is a value of the kinematic viscosity at 100° C. of a sample oil in which a viscosity index improver including a resin component is diluted in a mineral oil, and $Kv_1$ is a value of the kinematic viscosity at 100° C. after the sample oil in which the viscosity index improver including the resin component is diluted in the mineral oil is passed through a high shear diesel injector for 30 cycles according to the procedure of ASTM D 6278. $Kv_{oil}$ is a value of the kinematic viscosity at 100° C. of the mineral oil used when diluting the viscosity index improver.

The content of the comb-shaped polymer in terms of resin component is preferably 0.01 to 10% by mass, more preferably 0.05 to 5.0% by mass, and still more preferably 0.10 to 4.0% by mass, based on the total amount (100% by mass) of the lubricating oil composition.

Metal-Based Detergent

Examples of the metal-based detergent include an organic acid metal salt compound containing a metal atom selected from an alkali metal and an alkaline earth metal, and specific examples thereof include a metal salicylate, metal phenate, and metal sulfonate containing a metal atom selected from an alkali metal and an alkaline earth metal.

In the description herein, the "alkali metal" refers to lithium, sodium, potassium, rubidium, and cesium.

The "alkaline earth metal" refers to beryllium, magnesium, calcium, strontium, and barium.

The metal atom contained in the metal-based detergent is preferably sodium, calcium, magnesium, or barium, and more preferably calcium or magnesium, from the viewpoint of improving the detergency at high temperature.

The metal salicylate is preferably a compound represented by the following general formula (4), the metal phenate is preferably a compound represented by the following general formula (5), and the metal sulfonate is preferably a compound represented by the following general formula (6).

(4)

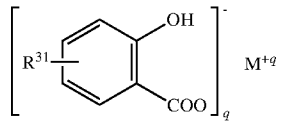

(5)

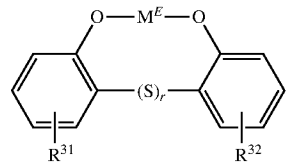

(6)

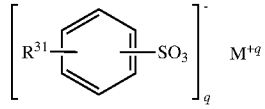

In the above general formulae (4) to (6), M is a metal atom selected from an alkali metal and an alkaline earth metal, preferably sodium, calcium, magnesium, or barium, and more preferably calcium or magnesium. ME is an alkaline earth metal, preferably calcium, magnesium, or barium, and more preferably calcium or magnesium. q is the valence of M and is 1 or 2. $R^{31}$ and $R^{32}$ are each independently a hydrogen atom or a hydrocarbon group having 1 to 18 carbon atoms. S represents a sulfur atom. r is an integer of 0 or more, and preferably an integer of 0 to 3.

Examples of the hydrocarbon group which may be selected as $R^{31}$ and $R^{32}$ include an alkyl group having 1 to 18 carbon atoms, an alkenyl group having 1 to 18 carbon atoms, a cycloalkyl group having 3 to 18 ring carbon atoms, an aryl group having 6 to 18 ring carbon atoms, an alkylaryl group having 7 to 18 carbon atoms, and an arylalkyl group having 7 to 18 carbon atoms.

These may be used alone or may be used in combination of two or more thereof. Among these, one or more selected from calcium salicylate, calcium phenate, calcium sulfonate, magnesium salicylate, magnesium phenate, and magnesium sulfonate are preferable from the viewpoint of improving the high-temperature detergent dispersibility and from the viewpoint of the solubility in the base oil.

These metal-based detergents may be any of neutral salts, basic salts, overbased salts, and mixtures thereof.

The base number of the metal-based detergent is preferably 0 to 600 mgKOH/g.

When the metal-based detergent is a basic salt or an overbased salt, the base number of the metal-based detergent is preferably 10 to 600 mgKOH/g, and more preferably 20 to 500 mgKOH/g.

In the description herein, the term "base number" means a base number measured by a perchloric acid method in accordance with 7. of JIS K 2501:2003 "Petroleum products and lubricants—Determination of neutralization number".

In the lubricating oil composition of the present embodiment, the content of the metal-based detergent is preferably 0.01% by mass to 10% by mass, more preferably 0. 1% by mass to 5.0% by mass, still more preferably 0.2% by mass to 4.0% by mass, and even more preferably 0.3% by mass to 3.0% by mass, based on the total amount (100% by mass) of the lubricating oil composition, from the viewpoint of more easily exhibiting the effects of the present invention.

The metal-based detergent may be used alone or may be used in combination of two or more thereof. When two or more kinds are used, the preferable total content is also the same as the content described above.

In the lubricating oil composition of the present embodiment, in the case where the metal-based detergent includes a calcium-based detergent, the content of calcium derived from the calcium-based detergent is preferably 0.01% by mass or more, more preferably 0.05% by mass or more, and still more preferably 0.10% by mass or more, based on the total amount (100% by mass) of the lubricating oil composition, from the viewpoint of high-temperature detergent dispersibility.

On the other hand, the content of calcium atoms derived from the metal-based detergent is preferably 0.25% by mass or less, more preferably 0.22% by mass or less, and still more preferably 0.20% by mass or less, based on the total amount (100% by mass) of the lubricating oil composition, from the viewpoint of reducing the sulfated ash content and from the viewpoint of preventing LSPI (abnormal combustion).

The upper limit values and the lower limit values of these numerical ranges can be arbitrarily combined. Specifically, the content is preferably 0.01% by mass to 0.25% by mass, more preferably 0.05% by mass to 0.22% by mass, and still more preferably 0.10% by mass to 0.20% by mass.

In the lubricating oil composition of the present embodiment, in the case where the metal-based detergent includes a magnesium-based detergent, the content of magnesium derived from the magnesium-based detergent is preferably 0.01% by mass or more, more preferably 0.02% by mass or more, and still more preferably 0.03% by mass or more, based on the total amount (100% by mass) of the lubricating oil composition, from the viewpoint of high-temperature detergent dispersibility.

On the other hand, the content of magnesium atoms derived from the metal-based detergent is preferably 0.20% by mass or less, more preferably 0.15% by mass or less, and still more preferably 0.07% by mass or less, based on the total amount (100% by mass) of the lubricating oil composition, from the viewpoint of reducing the sulfated ash content and from the viewpoint of preventing LSPI (abnormal combustion).

The upper limit values and the lower limit values of these numerical ranges can be arbitrarily combined. Specifically, it is preferably 0.01% by mass to 0.20% by mass, more preferably 0.02% by mass to 0.15% by mass, and still more preferably 0.03% by mass to 0.07% by mass.

Ash-free Dispersant

Examples of the ash-free dispersant include a boron-free succinimide such as a boron-free alkenyl succinimide, a boron-containing succinimide such as a boron-containing alkenyl succinimide, a benzylamine, a boron-containing benzylamine, a succinic acid ester, and a monovalent or divalent carboxylic acid amide typified by a fatty acid or succinic acid.

These may be used alone or may be used in combination of two or more thereof.

Among these, one or more succinimides selected from a boron-free alkenyl succinimide and a boron-containing alkenyl succinimide are preferable, and a combination of a boron-free alkenyl succinimide and a boron-containing alkenyl succinimide is more preferable, from the viewpoint of improving the detergency inside the engine.

When the lubricating oil composition of the present embodiment contains an ash-free dispersant, the content of nitrogen atoms derived from the ash-free dispersant is preferably 0.01% by mass to 0.15% by mass, more preferably 0.02% by mass to 0.10% by mass, and still more preferably 0.04% by mass to 0.06% by mass based on the total amount of the lubricating oil composition.

Pour Point Depressant

Examples of the pour point depressant include an ethylene-vinyl acetate copolymer, a condensate of chlorinated paraffin and naphthalene, a condensate of chlorinated paraffin and phenol, polymethacrylate (PMA; polyalkyl (meth) acrylate and the like), polyvinyl acetate, polybutene, and polyalkylstyrene, and polymethacrylate is preferably used.

These may be used alone or may be used in combination of two or more thereof.

Antioxidant

Examples of the antioxidant include an amine-based antioxidant and a phenol-based antioxidant.

Examples of the amine-based antioxidant include a diphenylamine-based antioxidant such as diphenylamine and an alkylated diphenylamine having an alkyl group having 3 to 20 carbon atoms; and a naphthylamine-based antioxidant such as phenyl-α-naphthylamine, phenyl-β-naphthylamine, a substituted phenyl-α-naphthylamine having an alkyl group having 3 to 20 carbon atoms, and a substituted phenyl-β-naphthylamine having an alkyl group having 3 to 20 carbon atoms.

Examples of the phenol-based antioxidant include a monophenol-based antioxidant such as 2,6-di-tert-butylphenol, 2,6-di-tert-butyl-4-methylphenol, 2,6-di-tert-butyl-4-ethylphenol, isooctyl-3-(3,5-di-tert-butyl-4-hydroxyphenyl) propionate, and octadecyl-3-(3,5-di-tert-butyl-4-hydroxyphenyl)propionate; a diphenol-based antioxidant such as 4,4'- and 2,2'-methylenebis(4-ethyl-6-tert-methylenebis(2,6-di-tert-butylphenol) butylphenol); and a hindered phenol-based antioxidant.

These may be used alone or may be used in combination of two or more thereof.

Anti-Wear Agent

Examples of the anti-wear agent include zinc-containing compounds such as zinc dialkyldithiophosphate (ZnDTP) and zinc phosphate; sulfur-containing compounds such as disulfides, sulfurized olefins, sulfurized oils and fats, sulfurized esters, thiocarbonates, thiocarbamates, and polysulfides; phosphorus-containing compounds such as phosphite esters, phosphate esters, phosphonate esters, and amine or metal salts thereof; and sulfur- and phosphorus-containing anti-wear agents such as thiophosphite esters, thiophosphate esters, thiophosphonate esters, and amine or metal salts thereof.

Among these, zinc dialkyldithiophosphate (ZnDTP) is preferable.

These may be used alone or may be used in combination of two or more thereof.

When the lubricating oil composition of the present embodiment contains zinc dialkyldithiophosphate (ZnDTP), the content of phosphorus derived from zinc dialkyldithiophosphate (ZnDTP) is preferably 0.01% by mass to 0.15% by mass, more preferably 0.02% by mass to 0.12% by mass, and still more preferably 0.06% by mass to 0.09% by mass based on the total amount (100% by mass) of the lubricating oil composition.

Friction Modifier Other than Component (M)

The lubricating oil composition of the present embodiment may contain a friction modifier other than the component (M).

Examples of the friction modifier other than the component (M) include ash-free friction modifiers such as aliphatic amines, fatty acid esters, fatty acid amides, fatty acids, aliphatic alcohols, and aliphatic ethers; oils and fats; amines, amides, sulfurized esters, phosphate esters, phosphite esters, and phosphate ester amine salts.

These may be used alone or may be used in combination of two or more thereof.

Extreme Pressure Agent

Examples of the extreme pressure agent include a sulfur-based extreme pressure agent such as a sulfide, a sulfoxide, a sulfone, and a thiophosphinate, a halogen-based extreme pressure agent such as a chlorinated hydrocarbon, and an organic metal-based extreme pressure agent. In addition, among the above-described anti-wear agents, a compound having a function as an extreme pressure agent can also be used.

These may be used alone or may be used in combination of two or more thereof.

Rust Inhibitor

Examples of the rust inhibitor include a fatty acid, an alkenyl succinic acid half ester, a fatty acid soap, an alkyl sulfonate, a polyhydric alcohol fatty acid ester, a fatty acid amine, an oxidized paraffin, and an alkyl polyoxyethylene ether.

These may be used alone or may be used in combination of two or more thereof.

Anti-Foaming Agent

Examples of the anti-foaming agent include a silicone oil such as dimethylpolysiloxane, a fluorosilicone oil, and a fluoroalkyl ether.

These may be used alone or may be used in combination of two or more thereof.

Oiliness Improver

Examples of the oiliness improver include an aliphatic saturated or unsaturated monocarboxylic acid such as stearic acid and oleic acid; a polymerized fatty acid such as dimer acid and hydrogenated dimer acid; a hydroxy fatty acid such as ricinoleic acid and 12-hydroxystearic acid; an aliphatic saturated or unsaturated monoalcohol such as lauryl alcohol and oleyl alcohol; an aliphatic saturated or unsaturated monoamine such as stearylamine and oleylamine; an aliphatic saturated or unsaturated monocarboxylic acid amide such as lauric acid amide and oleic acid amide; and a partial ester of a polyhydric alcohol and an aliphatic saturated or unsaturated monocarboxylic acid, such as glycerin and sorbitol.

Demulsifier

Examples of the demulsifier include anionic surfactants such as sulfuric acid ester salts of castor oil and petroleum sulfonic acid salts; cationic surfactants such as quaternary ammonium salts and imidazolines; polyalkylene glycol-based nonionic surfactants such as polyoxyethylene alkyl ethers, polyoxyethylene alkyl phenyl ethers, and polyoxyethylene alkyl naphthyl ethers; polyoxyalkylene polyglycols and esters of dicarboxylic acids thereof, and alkylene oxide adducts of alkylphenol-formaldehyde polycondensates.

These may be used alone or may be used in combination of two or more thereof.

The content of the other components described above can be appropriately adjusted within a range that does not impair the effects of the present invention, but each of the contents is usually 0.001% by mass to 15% by mass, and preferably 0.005% by mass to 10% by mass, based on the total amount (100% by mass) of the lubricating oil composition.

In the description herein, the additives as the other components may be mixed with the other components in the form of a solution obtained by diluting and dissolving the additives in a part of the base oil (P) in consideration of handleability, solubility in the base oil (P), and the like. In such a case, in the description herein, the above-mentioned content of the additives as the other components means the content in terms of the active components (in terms of resin component) excluding a diluent oil.

Physical Properties and the like of Lubricating Oil Composition

Kinematic Viscosity, Viscosity Index

The lubricating oil composition according to the present embodiment is required to have a 100° C. kinematic viscosity of 8.2 $mm^2/s$ or less. When the 100° C. kinematic viscosity of the lubricating oil composition is more than 8.2 $mm^2/s$, the effect of improving fuel efficiency is less likely to be obtained due to stirring loss caused by viscous resistance of the lubricating oil composition.

From the viewpoint of more easily obtaining the effect of improving fuel efficiency, the 100° C. kinematic viscosity of the lubricating oil composition is preferably 7.8 $mm^2/s$ or less, more preferably 7.1 $mm^2/s$ or less, and still more preferably 6.1 $mm^2/s$ or less.

On the other hand, from the viewpoint of more easily suppressing the evaporation loss of the lubricating oil composition, the 100° C. kinematic viscosity of the lubricating oil composition is preferably 3.8 $mm^2/s$ or more, more preferably 4.0 $mm^2/s$ or more, and still more preferably 5.0 $mm^2/s$ or more.

The viscosity index of the lubricating oil composition according to the present embodiment is preferably 150 or more, more preferably 200 or more, and still more preferably 220 or more.

HTHS Viscosity at 150° ° C.

The HTHS viscosity (high temperature high shearing viscosity) at 150° C. of the lubricating oil composition according to the present embodiment is preferably 1.7 mPa·s or more, and more preferably 2.0 mPa·s or more, from the viewpoint of oil film retainability. On the other hand, from the viewpoint of improving fuel saving performance, the HTHS viscosity at 150° C. of the lubricating oil composition according to the present embodiment is preferably less than 2.9 mPa·s, more preferably less than 2.6 mPa·s, and still more preferably less than 2.3 mPa·s.

In the description herein, the HTHS viscosity at 150° C. of the lubricating oil composition is a value measured in accordance with ASTM D 4683 using a TBS-high temperature viscosimeter (Tapered Bearing Simulator Viscometer) at a shear rate of 106/s under a temperature condition of 150° C.

Noack Value

The lubricating oil composition according to the present embodiment has a Noack value (250° C., 1 hour) of preferably 25% by mass or less, more preferably 23% by mass or less, and still more preferably 22% by mass or less. When the Noack value is within the above range, an increase in the viscosity of the lubricating oil composition can be suppressed, and a decrease in fuel efficiency can be suppressed. The Noack value is usually 0. 1% by mass or more.

In the description herein, the Noack value is a value measured in accordance with JPI-5S-41-2004 under conditions of 250° C. and 1 hour.

Various Atom Contents

The various atom contents of the lubricating oil composition of the present embodiment are as described below.

In the description herein, the molybdenum content, calcium content, magnesium content, and phosphorus content of the lubricating oil composition are values measured in accordance with JIS-5S-38-03.

Molybdenum Content

In the lubricating oil composition of the present embodiment, the molybdenum content is preferably 0.01% by mass or more, more preferably 0.04% by mass or more, and still more preferably 0.05% by mass or more, based on the total amount of the lubricating oil composition, from the viewpoint of improving the friction reducing action.

On the other hand, the content of the molybdenum atoms is preferably 0.20% by mass or less, more preferably 0.15% by mass or less, and still more preferably 0.12% by mass or less, based on the total amount of the lubricating oil composition, from the viewpoint of reducing the sulfated ash content.

The upper limit values and the lower limit values of these numerical ranges can be arbitrarily combined. Specifically, the content is preferably 0.01% by mass to 0.20% by mass, more preferably 0.04% by mass to 0.15% by mass, and still more preferably 0.05% by mass to 0.12% by mass.

Calcium Content

In the lubricating oil composition of the present embodiment, the calcium content is preferably 0.01% by mass or more, more preferably 0.05% by mass or more, and still more preferably 0.10% by mass or more, based on the total amount of the lubricating oil composition, from the viewpoint of more easily improving the high-temperature detergency.

On the other hand, the calcium content is preferably 0.25% by mass or less, more preferably 0.22% by mass or less, and still more preferably 0.20% by mass or less, based on the total amount of the lubricating oil composition, from the viewpoint of reducing the sulfated ash content and from the viewpoint of preventing LSPI (abnormal combustion).

The upper limit values and the lower limit values of these numerical ranges can be arbitrarily combined. Specifically, the content is preferably 0.01% by mass to 0.25% by mass, more preferably 0.05% by mass to 0.22% by mass, and still more preferably 0.10% by mass to 0.20% by mass.

Magnesium Content

In the lubricating oil composition of the present embodiment, the magnesium content is preferably 0.01% by mass or more, more preferably 0.02% by mass or more, and still more preferably 0.03% by mass or more, based on the total amount of the lubricating oil composition, from the viewpoint of more easily improving the high-temperature detergency.

On the other hand, the magnesium content is preferably 0.20% by mass or less, more preferably 0.15% by mass or less, and still more preferably 0.07% by mass or less, based on the total amount of the lubricating oil composition, from the viewpoint of reducing the sulfated ash content and from the viewpoint of preventing LSPI (abnormal combustion).

The upper limit values and the lower limit values of these numerical ranges can be arbitrarily combined. Specifically, it is preferably 0.01% by mass to 0.20% by mass, more preferably 0.02% by mass to 0.15% by mass, and still more preferably 0.03% by mass to 0.07% by mass.

Phosphorus Content

In the lubricating oil composition of the present embodiment, the phosphorus content is preferably 0.01% by mass to 0.15% by mass, more preferably 0.02% by mass to 0.12% by mass, and still more preferably 0.06% by mass to 0.09% by mass based on the total amount (100% by mass) of the lubricating oil composition.

Method for Producing Lubricating Oil Composition

The method for producing the lubricating oil composition of the present embodiment is not particularly limited.

For example, the method for producing the lubricating oil composition of the present embodiment includes a step of mixing the base oil (P) and the copolymer (X).

The copolymer (X) contains the following structural units (a) to (c):

Structural unit (a): a structural unit derived from a monomer (A) having a (meth)acryloyl group and a linear or branched alkyl group having 6 to 24 carbon atoms;

Structural unit (b): a structural unit derived from a monomer (B) having a (meth)acryloyl group and a polar group;

Structural unit (c): a structural unit derived from a monomer (C) having a polymerizable functional group and a cyclic structural group; and the copolymer (X) has a mass-average molecular weight (Mw) of 5,000 to 50,000; a content of the copolymer (X) in terms of resin component is 0.10% by mass to 2.5% by mass based on the total amount of the lubricating oil composition; and the lubricating oil composition has a 100° C. kinematic viscosity of 8.2 $mm^2/s$ or less.

The production method may further include a step of blending one or more selected from other components, as necessary.

The method of mixing the respective components is not particularly limited, and examples thereof include a method of blending the respective components with the base oil (P). Further, the respective components may be blended in the form of a solution (dispersion) by adding a diluent oil or the like. After the respective components are blended, it is preferable to uniformly disperse the components by stirring according to a known method.

Use of Lubricating Oil Composition

In the lubricating oil composition according to the present embodiment, the friction coefficient is suppressed to be low in spite of low viscosity, and the variation in the friction coefficient is suppressed. Therefore, it is possible to improve lubricity in a sliding portion of the internal combustion engine, and it is possible to suppress occurrence of vibration and noise caused by the variation in the friction coefficient.

Therefore, the lubricating oil composition according to the present embodiment is preferably used in internal combustion engines, more preferably used in automobile engines, and still more preferably used in gasoline engines.

Therefore, the lubricating oil composition according to the present embodiment provides the following (1) to (3).

(1) A method of using the lubricating oil composition according to the present embodiment in an internal combustion engine.

(2) A method of using the lubricating oil composition according to the present embodiment in an automobile engine.

(3) A method of using the lubricating oil composition according to the present embodiment in a gasoline engine.

Lubrication Method Using Lubricating Oil Composition

As described above with respect to the use of the lubricating oil composition, the lubricating oil composition of the present embodiment is preferably used in internal combustion engines, more preferably used in automobile engines, and still more preferably used in gasoline engines.

Therefore, the lubricating oil composition of the present embodiment provides the following (4) to (6).

(4) A method for lubricating an internal combustion engine, including using the lubricating oil composition of the present embodiment.

(5) A method for lubricating an automobile engine, including using the lubricating oil composition of the present embodiment.

(6) A method for lubricating a gasoline engine, including using the lubricating oil composition of the present embodiment.

Internal Combustion Engine containing Lubricating Oil Composition

Another embodiment includes an internal combustion engine containing the lubricating oil composition of the present embodiment, and preferably an internal combustion engine (engine) containing the lubricating oil composition of the present embodiment as an engine oil. Examples of the internal combustion engine include an automobile engine, preferably a gasoline engine and the like.

One Aspect of the Invention Provided

According to one aspect of the present invention, the following [1] to are provided.

[1] A lubricating oil composition containing: a base oil (P); and a copolymer (X), wherein the copolymer (X) contains the following structural units (a) to (c):

Structural unit (a): a structural unit derived from a monomer (A) having a (meth)acryloyl group and a linear or branched alkyl group having 6 to 24 carbon atoms;

Structural unit (b): a structural unit derived from a monomer (B) having a (meth)acryloyl group and a polar group;

Structural unit (c): a structural unit derived from a monomer (C) having a polymerizable functional group and a cyclic structural group; and the copolymer (X) has a mass-average molecular weight (Mw) of 5,000 to 50,000;

a content of the copolymer (X) in terms of resin component is 0.10% by mass to 2.5% by mass based on the total amount of the lubricating oil composition, and the lubricating oil composition has a 100° C. kinematic viscosity of 8.2 $mm^2/s$ or less.

[2] The lubricating oil composition as set forth in [1], further containing a molybdenum-based friction modifier (M).

[3] The lubricating oil composition as set forth in [2], wherein the molybdenum-based friction modifier (M) contains one or more selected from the group consisting of a binuclear molybdenum dithiocarbamate, a trinuclear molybdenum dithiocarbamate, and a molybdenum amine complex.

[4] The lubricating oil composition as set forth in [3], wherein the binuclear molybdenum dithiocarbamate is a compound (M1) represented by the following general formula (m1):

(m1)

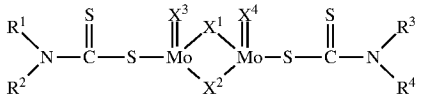

wherein, $R^1$, $R^2$, $R^3$, and R+each independently represent a short-chain substituent group (α) which is an aliphatic hydrocarbon group having 4 to 12 carbon atoms or a long-chain substituent group (β) which is an aliphatic hydrocarbon group having 13 to 22 carbon atoms, provided that the molar ratio [(α)/(β)] of the short-chain substituent group (a) to the long-chain substituent group (β) in the total molecule of the compound (M1) is 0.10 to 2.0, and X1, X2, X3, and X4 each independently represent an oxygen atom or a sulfur atom.

[5] The lubricating oil composition as set forth in [2] or [3], wherein a content of molybdenum derived from the molybdenum-based friction modifier (M) is 0.01% by mass to 0.20% by mass based on the total amount of the lubricating oil composition.

[6] The lubricating oil composition as set forth in any of [1] to [5], further containing a metal-based detergent.

[7] The lubricating oil composition as set forth in [6], wherein the metal-based detergent contains one or more selected from the group consisting of a calcium-based detergent and a magnesium-based detergent.

[8] The lubricating oil composition as set forth in [7], wherein the metal-based detergent contains the calcium-based detergent, and a content of calcium derived from the calcium-based detergent is 0.01% by mass to 0.25% by mass based on the total amount of the lubricating oil composition.

[9] The lubricating oil composition as set forth in [7] or [8], wherein the metal-based detergent contains the magnesium-based detergent, and a content of magnesium derived from the magnesium-based detergent is 0.01% by mass to 0.20% by mass based on the total amount of the lubricating oil composition.

[10] The lubricating oil composition as set forth in any of [1] to [9], further containing an ash-free dispersant.

[11] The lubricating oil composition as set forth in [10], wherein a content of nitrogen derived from the ash-free dispersant is 0.01% by mass to 0.15% by mass based on the total amount of the lubricating oil composition.

[12] The lubricating oil composition as set forth in any of [1] to [11], further containing zinc dithiophosphate.

[13] The lubricating oil composition as set forth in [12], wherein a content of phosphorus derived from the zinc dithiophosphate is 0.01% by mass to 0.10% by mass based on the total amount of the lubricating oil composition.

[14] The lubricating oil composition as set forth in any of [1] to [13], which is used in an internal combustion engine.

[15] The lubricating oil composition as set forth in any of [1] to [13], which is used in a gasoline engine.

EXAMPLES

The present invention is described in more detail by reference to Examples given below, but it should be construed that the present invention is by no means limited to these Examples.

Measurement Method of Various Physical Properties

The raw materials used in Examples and Comparative Examples and the properties of the lubricating oil compositions of Examples and Comparative Examples were measured in the following manner.

(1) Kinematic Viscosity, Viscosity Index

The 40° C. kinematic viscosity, the 100° C. kinematic viscosity, and the viscosity index of the base oil and the lubricating oil composition were measured or calculated in accordance with JIS K 2283:2000.

(2) HTHS Viscosity at 150° C.

The HTHS viscosity at 150° C. of the lubricating oil composition was measured in accordance with ASTM D 4683 using a TBS-high temperature viscosimeter (Tapered Bearing Simulator Viscometer) at a shear rate of 106/s under a temperature condition of 150° C.

(3) Noack Value

The noack value of the lubricating oil composition was measured in accordance with ASTM D 5800 (Noack test: 250° ° C., 1 hour).

(4) Mass Average Molecular Weight (Mw), Molecular Weight Distribution (Mw/Mn)

One column "TSK guardcolumn SuperHZ-L" and two columns "TSK SuperMultipore HZ-M" manufactured by Tosoh Corporation were attached to "1515 Isocratic HPLC Pump" and "2414 Differential Refractive Index (RI) Detector" manufactured by Waters Corporation in this order from the upstream side, and the measurement was performed under the conditions of measurement temperature: 40° C., moving phase: tetrahydrofuran, flow rate: 0.35 mL/min, sample concentration: 1.0 mg/mL, and calculated in terms of standard polystyrene.

(5) PSSI (Shear Stability Index)

The PSSI indicates a decrease in viscosity due to shearing derived from a polymer in percentage, and was calculated by the following calculation formula defined in ASTM D 6022-06 (2012).

$$PSSI = \frac{K_{V0} - K_{V1}}{K_{V0} - K_{Voil}} \times 100$$

In the above calculation formula, $Kv_0$ is a value of 100° ° C. kinematic viscosity of the mixture obtained by adding the polymer to the base oil (before shearing). $Kv_1$ is a value of 100° C. kinematic viscosity (after shearing) of the mixture obtained by adding the polymer to the base oil measured in accordance with ASTM D 6278. $Kv_{oil}$ is a value of 100° C. kinematic viscosity of the base oil, and $Kv_0$ was adjusted to 4.0 $mm^2/s$.

(6) Molybdenum Content, Calcium Content, Magnesium Content, and Phosphorus Content The molybdenum content, calcium content, magnesium content, and phosphorus content of the lubricating oil composition were measured in accordance with JIS-5S-38-03.

Production Examples 1 and 2

Copolymer (X)-1 and Copolymer (X)-2 were produced according to Production Examples 1 and 2 described below.

Monomer Used

Monomer(A)

"Dodecyl acrylate": a compound represented by the above general formula (a-1) in which $R^{a1}$ is a hydrogen atom and $R^{a2}$ is a dodecyl group (a linear alkyl group having 12 carbon atoms).

Monomer (B)

"2-hydroxyethyl acrylate": a monomer having an acryloyl group and a hydroxy group as a polar group. The structural formula is shown below.

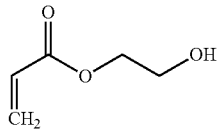

Monomer (C)

"Benzyl acrylate": a monomer in which the polymerizable functional group is an acryloyl group and the cyclic structure is benzene. Specifically, in the above general formula (c-1), Y is an acryloyl group, $L^1$ is an oxymethylene group, and Z is a phenyl group.

Production Example 1: Production of Copolymer (X)-1

In a reaction container equipped with a stirring apparatus, a heating/cooling apparatus, a thermometer, a dropping funnel, and a nitrogen-blowing tube, 20 g (83 mmol) of dodecyl acrylate was charged as the monomer (A), and 28 g of 2-ethylhexyl sebacate was charged as the solvent.

Next, the inside of the reaction container was replaced with nitrogen, 0.1 g (0.4 mmol) of 2,2'-azobis(2,4-dimethylvaleronitrile) and 0.13g (0.4 mmol) of dodecylcyanomethyl trithiocarbonate were added as initiators, the temperature was slowly increased while stirring, and the mixture was allowed to react at a temperature of 75 to 85° C. for 6 hours. After it was confirmed that the dodecyl acrylate was converted into the polymer by 96% or more, 5 g (31 mmol) of benzyl acrylate as the monomer (C) and 0.05 g (0.2 mmol) of 2,2'-azobis(2,4-dimethylvaleronitrile) were added, and the mixture was further reacted at a temperature of 75 to 85° C. for 6 hours. After it was confirmed that the benzyl acrylate was converted into the polymer by 96% or more, 3 g (26 mmol) of 2-hydroxyethyl acrylate as the monomer (B) and 0.05 g (0.2 mmol) of 2,2'-azobis(2,4-dimethylvaleronitrile) were added, and the mixture was further reacted at a temperature of 75 to 85° ° C. for 6 hours. After completion of the reaction, the unreacted monomer was distilled off under reduced pressure to obtain Copolymer (X)-1.

Production Example 2: Production of Copolymer (X)-2

In a reaction container equipped with a stirring apparatus, a heating/cooling apparatus, a thermometer, a dropping funnel, and a nitrogen-blowing tube, 20 g (83 mmol) of dodecyl acrylate, 3 g (26 mmol) of 2-hydroxyethyl acrylate, 5 g (31 mmol) of benzyl acrylate, and 28 g of 2-ethylhexyl sebacate as the solvent were charged.

Next, the inside of the reaction container was replaced with nitrogen, 0.1 g (0.4 mmol) of 2,2'-azobis(2,4-dimethylvaleronitrile) and 0.08 g (0.4 mmol) of dodecylmercaptan were added as initiators, the temperature was slowly increased while stirring, and the mixture was allowed to react at a temperature of 75 to 85° C. for 6 hours. After completion of the reaction, the unreacted monomer was distilled off under reduced pressure to obtain Copolymer (X)-2.

The compositions and properties of Copolymer (X)-1 and Copolymer (X)-2 are shown in Table 1.

TABLE 1

| | | | Unit | Production Example 1 Copolymer (X)-1 | Production Example 2 Copolymer (X)-2 |
|---|---|---|---|---|---|
| Copolymer composition | Monomer (A) | Dodecyl acrylate | % by mass | 71.4 | 71.4 |
| | Monomer (B) | 2-Hydroxyethyl acrylate | % by mass | 10.7 | 10.7 |
| | Monomer (C) | Benzyl acrylate | % by mass | 17.9 | 17.9 |
| | | Total | % by mass | 100 | 100 |
| | Structural unit (a) | Dodecyl acrylate | mol % | 59.5 | 59.5 |
| | Structural unit (b) | 2-Hydroxyethyl acrylate | mol % | 18.5 | 18.5 |
| | Structural unit (c) | Benzyl acrylate | mol % | 22.0 | 22.0 |
| | | Total | mol % | 100 | 100 |
| Properties of Copolymer | | $Mw \times 10^4$ | — | 2.7 | 2.6 |
| | | $Mn \times 10^4$ | — | 1.7 | 1.4 |
| | | Mw/Mn | — | 1.6 | 1.9 |

Examples 1 to 4, Comparative Examples 1 to 5

Each of the components shown below was added in the content shown in Table 2 and sufficiently mixed to obtain a lubricating oil composition.

Details of each of the components used in Examples 1 to 4 and Comparative Examples 1 to 5 are as follows.

Base Oil (P)

Base Oil (P1)

Mineral oil (classified in API-category: Group III, 40° C. kinematic viscosity: 18.5 $mm^2/s$, 100° C. kinematic viscosity: 4.1 $mm^2/s$, viscosity index: 125, Noack value: 12% by mass)

Base Oil (P2)

Mineral oil (classified in API-category: Group II, 40° C. kinematic viscosity: 9.7 $mm^2/s$, 100° C. kinematic viscosity: 2.7 $mm^2/s$, viscosity index: 111, Noack value: 43% by mass)

Base Oil (P3)

Mineral oil (classified in API-category: Group III, 40° C. kinematic viscosity: 19.7 $mm^2/s$, 100° C. kinematic viscosity: 4.3 $mm^2/s$, viscosity index: 123, Noack value: 14% by mass)

Base Oil (P4)

Mineral oil (classified in API-category: Group II, 40° C. kinematic viscosity: 8.0 $mm^2/s$, 100° C. kinematic viscosity: 2.3 $mm^2/s$, viscosity index: 102, Noack value: 74% by mass)

Copolymer (X)

Copolymer (X)-1 and Copolymer (X)-2 produced in Production Examples 1 and 2 were used.

Comparative Polymer

Dispersant-type PMA

Comparative polymer was used to compare the effect with Copolymer (X).

Mass average molecular weight (Mw): 57,000, molecular weight distribution (Mw/Mn): 2.19, PMA containing a dimethylaminoethyl group.

<Molybdenum-based Friction Modifier (M)>

"Binuclear molybdenum dithiocarbamate"

As the binuclear molybdenum dithiocarbamate (hereinafter, also referred to as "binuclear MoDTC"), a compound represented by the general formula (m1), in which the aliphatic hydrocarbon group of the short-chain substituent group (α) has 8 carbon atoms and the aliphatic hydrocarbon group of the long-chain substituent group (β) has 13 carbon atoms, was used. In the general formula (m1), $X^1$, $X^2$, $X^3$, and $X^4$ each are a sulfur atom. The molar ratio [(α)/(β)] of the short-chain substituent group (α) to the long-chain substituent group (β) in the total molecule of the binuclear MoDTC is 1.0.

Trinuclear molybdenum dithiocarbamate

As the trinuclear molybdenum dithiocarbamate (hereinafter also referred to as "trinuclear MoDTC"), trinuclear molybdenum dithiocarbamate having a molybdenum atom content of 5.3% by mass was used.

Molybdenum amine complex

As the molybdenum amine complex, dialkylamine molybdate (molybdenum atom content: 7.9% by mass) was used.

Other Additives

Viscosity Index Improver

Comb-shaped PMA

Mass average molecular weight (Mw): 310,000, molecular weight distribution (Mw/Mn): 1.93, PSSI: 1

Benzotriazole-Based Compound

As the metal deactivator, 1-[N,N-bis(2-ethylhexyl)aminomethyl]-4-methyl-1H-benzotriazole, which is a benzotriazole-based compound, was used.

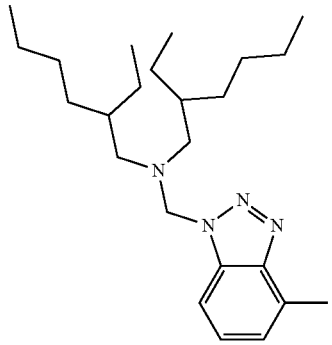

1-[N, N-bis(2-ethylhexyl)aminomethyl]-4-methyl-1H-benzotriazole is a compound of the general formula (c1) wherein Rel is a methyl group, p is 1, $R^{c2}$ is a methylene group, and $R^{c3}$ and $R^{c4}$ each are a 2-ethylhexyl group.

Additive Package

This is an additive package conforming to the API/ILSAC standard and the SN/GF-6 standard, and contains the following various additives.

Metal-based detergent: calcium sulfonate, magnesium sulfonate

Dispersant: succinimide (nitrogen content: 1.4% by mass), boron-modified imide

Anti-wear agent: ZnDTP (P content: 6.7% by mass, Zn content: 7.4% by mass)

Antioxidant: amine-based antioxidant, phenol-based antioxidant

Pour point depressant

Evaluation Method

The test described below was carried out to evaluate the reduction in friction coefficient and the variation in friction coefficient.

Further, in order to confirm the solubility of the copolymer in a mineral oil, an appearance evaluation was carried out.

Furthermore, in order to evaluate the fuel saving performance of the lubricating oil composition blended with the copolymer, a fuel economy test was carried out.

Evaluation of Reduction in Friction Coefficient and Variation in Friction Coefficient By using an SRV tester (manufactured by Optimol Co., Ltd.) under the following conditions, the friction coefficient when using the prepared lubricating oil composition was measured.

Cylinder: AISI52100
Disk: AISI52100
Frequency: 50 Hz
Amplitude: 1.5 mm
Load: 400 N
Temperature: 30 to 140° C., Raise temperature every 10° ° C.
Test time: 5 minutes at each temperature First, the test was carried out while sliding under the following conditions for 5 minutes at each temperature while raising the temperature every 10° C. from 30° C. to 130° C., and the friction coefficient was measured every second during the final 1 minute at 130° C., and the mean value and standard deviation of the friction coefficient during the final 1 minute were calculated.

In addition, the test was carried out while sliding under the following conditions for 5 minutes at each temperature while raising the temperature every 10° C. from 30° C. to 140° C., and the friction coefficient was measured every second during the final 1 minute at 140° C., and the mean value and standard deviation of the friction coefficient during the final 1 minute were calculated.

Then, the "difference between the mean value of the friction coefficient of each lubricating oil composition and the mean value of the friction coefficient of the lubricating oil composition of Comparative Example 1" was divided by the "mean value of the friction coefficient of the lubricating oil composition of Comparative Example 1" to calculate a reduction rate (%) from the mean value of the friction coefficient of Comparative Example 1 for the mean value of the friction coefficient of each lubricating oil composition.

A larger reduction rate from the mean value of the friction coefficient of Comparative Example 1 means that the effect of reducing the friction coefficient is excellent.

In the present Examples, those having the reduction rate of 10% or more were regarded as acceptable.

In addition, by dividing "the difference between the standard deviation of the friction coefficient of each lubricating oil composition and the standard deviation of the friction coefficient of the lubricating oil composition of Comparative Example 1" by "the standard deviation of the friction coefficient of the lubricating oil composition of Comparative Example 1", a reduction rate (%) from the standard deviation of the friction coefficient of Comparative Example 1 was calculated for the standard deviation of the friction coefficient of each lubricating oil composition.

A larger reduction rate from the standard deviation of the friction coefficient of Comparative Example 1 means that the variation in the friction coefficient is more suppressed.

In the present Examples, those having the reduction rate of 60% or more were regarded as acceptable.

Appearance Evaluation

The lubricating oil composition was heated to 80° C., stirred for 30 minutes, and then allowed to stand until it reached room temperature (25° C.). Then, the appearance of the lubricating oil composition when it reached room temperature was visually evaluated. A sample in which turbidity was not observed was evaluated as "A", and a sample in which turbidity was observed was evaluated as "B".

Evaluation of Fuel Saving Performance

In accordance with JASO M366:2019 "Automobile Gasoline Engine Oils. Firing Fuel Economy Test Procedure", the lubricating oil compositions of Example 3 and Comparative Example 5 were subjected to a test, and the improvement in fuel economy of the lubricating oil composition of Example 3 with respect to the lubricating oil composition of Comparative Example 5 was measured.

The results are shown in Table 2.

TABLE 2

| | | | | Comparative Example | | | | | Example | | | |
|---|---|---|---|---|---|---|---|---|---|---|---|---|
| | | | Unit | 1 | 2 | 3 | 4 | 5 | 1 | 2 | 3 | 4 |
| Component composition of Lubricating oil composition | Base oil (P) | Base oil (P1) | % by mass | 90.91 | 56.01 | 55.86 | | 56.71 | | | 56.26 | 55.76 |
| | | Base oil (P2) | % by mass | | 31.90 | 31.90 | | 31.90 | | | 31.90 | 31.90 |
| | | Base oil (P3) | % by mass | | | | 70.61 | | 70.36 | 70.36 | | |
| | | Base oil (P4) | % by mass | | | | 18.00 | | 18.00 | 18.00 | | |
| | Copolymer (X) | Copolymer (X)-1 | % by mass | | | | | | 0.25 | | | |
| | | Copolymer (X)-2 | % by mass | | | | | | | 0.25 | 0.75 | 0.25 |
| | Dispersant-type PMA | | % by mass | | | 0.15 | | | | | | |
| | Molybdenum-based Friction modifier (M) | Binuclear MoDTC | % by mass | 0.60 | 0.60 | 0.60 | 0.60 | 0.60 | 0.60 | 0.60 | 0.60 | 0.60 |
| | | Trinuclear MoDTC | % by mass | 0.18 | 0.18 | 0.18 | 0.18 | 0.18 | 0.18 | 0.18 | 0.18 | 0.18 |
| | | Molybdenum amine complex | % by mass | 0.15 | 0.15 | 0.15 | 0.15 | 0.15 | 0.15 | 0.15 | 0.15 | 0.15 |
| | Benzotriazole-based compound (Metal deactivator) | | % by mass | 0.01 | 0.01 | 0.01 | 0.01 | 0.01 | 0.01 | 0.01 | 0.01 | 0.01 |

TABLE 2-continued

| | | | Unit | Comparative Example 1 | 2 | 3 | 4 | 5 | Example 1 | 2 | 3 | 4 |
|---|---|---|---|---|---|---|---|---|---|---|---|---|
| | Comb-shaped PMA (Viscosity index improver) | | % by mass | | 3.00 | 3.00 | 2.30 | 2.30 | 2.30 | 2.30 | 2.00 | 3.00 |
| | Additive package | | % by mass | 8.15 | 8.15 | 8.15 | 8.15 | 8.15 | 8.15 | 8.15 | 8.15 | 8.15 |
| | Total | | % by mass | 100.00 | 100.00 | 100.00 | 100.00 | 100.00 | 100.00 | 100.00 | 100.00 | 100.00 |
| Properties | 40° C. kinematic viscosity of base oil (P) | | $mm^2/s$ | 18.5 | 14.0 | 13.9 | 15.7 | 13.9 | 15.7 | 15.7 | 13.9 | 13.9 |
| | 100° C. kinematic viscosity of base oil (P) | | $mm^2/s$ | 4.12 | 3.41 | 3.40 | 3.66 | 3.40 | 3.66 | 3.66 | 3.40 | 3.40 |
| | 140° C. kinematic viscosity of base oil (P) | | $mm^2/s$ | 2.28 | 1.94 | 1.94 | 2.06 | 1.94 | 2.06 | 2.06 | 1.94 | 1.94 |
| | 40° C. kinematic viscosity of lubricating oil composition | | $mm^2/s$ | 24.0 | 23.4 | 23.5 | 25.1 | 22.3 | 25.5 | 25.3 | 22.6 | 23.5 |
| | 100° C. kinematic viscosity of lubricating oil composition | | $mm^2/s$ | 5.04 | 6.95 | 7.16 | 7.01 | 6.15 | 7.17 | 7.12 | 6.16 | 7.05 |
| | Viscosity index of lubricating oil composition | | — | 143 | 289 | 301 | 267 | 250 | 271 | 270 | 247 | 293 |
| | HTHS of lubricating oil composition (150° C.) | | mPa · s | 1.8 | 2.6 | 2.7 | 2.6 | 2.3 | 2.7 | 2.6 | 2.3 | 2.6 |
| | Noack value of lubricating oil composition (250° C.) | | % by mass | 12 | 22 | 22 | 22 | 22 | 22 | 22 | 22 | 22 |
| | Mo content in lubricating oil composition | | % by mass | 0.08 | 0.08 | 0.08 | 0.08 | 0.08 | 0.08 | 0.08 | 0.08 | 0.08 |
| | Ca content in lubricating oil composition | | % by mass | 0.12 | 0.12 | 0.12 | 0.12 | 0.12 | 0.12 | 0.12 | 0.12 | 0.12 |
| | Mg content in lubricating oil composition | | % by mass | 0.05 | 0.05 | 0.05 | 0.05 | 0.05 | 0.05 | 0.05 | 0.05 | 0.05 |
| | P content in lubricating oil composition | | % by mass | 0.08 | 0.08 | 0.08 | 0.08 | 0.08 | 0.08 | 0.08 | 0.08 | 0.08 |
| | N content derived from ash free dispersant in lubricating oil composition | | % by mass | 0.04 | 0.04 | 0.04 | 0.04 | 0.04 | 0.04 | 0.04 | 0.04 | 0.04 |
| Evaluation results | Reduction rate of friction coefficient | 130° C. | % | Reference | 5 | 13 | 13 | 14 | 12 | 13 | 18 | 24 |
| | | 140° C. | % | Reference | 10 | 19 | 17 | 21 | 18 | 18 | 23 | 30 |
| | Reduction rate of standard deviation | 130° C. | % | Reference | −30 | −19 | 53 | −52 | 69 | 83 | 76 | 92 |
| | | 140° C. | % | Reference | 28 | 7 | 54 | 11 | 77 | 81 | 83 | 95 |
| | 2ZR-FXE Firing fuel economy (JASO M366 Test procedure) Fuel consumption improvement rate relative to reference | | % | | | | | Reference | | | 0.1 | |
| | Appearance evaluation | Room temperature, Presence or absence of turbidity | | A | A | A | A | A | A | A | A | A |

From Table 2, the following can be seen.

It can be seen that in the lubricating oil compositions of Examples 1 to 4 in which Copolymer (X)-1 or Copolymer (X)-2 was blended, the friction coefficient was suppressed to be low, and the variation in the friction coefficient was also small. In addition, it can be seen that no turbidity of the lubricating oil composition is observed from the appearance evaluation result and the solubility of Copolymer (X)-1 or Copolymer (X)-2 in the mineral oil was also good.

On the other hand, in the lubricating oil compositions of Comparative Examples 2, 4, and 5 in which Copolymer (X) was not blended, the 100° C. kinematic viscosity was higher than that of the lubricating oil composition of Comparative Example 1. Therefore, it can be seen that the friction coefficient was suppressed to be low, but the variation in the friction coefficient was large.

In addition, it can be seen that the lubricating oil composition of Comparative Example 3 in which the dispersant-type PMA is blended instead of Copolymer (X) also had a low friction coefficient, but the variation in the friction coefficients was large.

From the evaluation results of the fuel saving performance, it is understood that the lubricating oil composition of Example 3 in which Copolymer (X)-2 was blended had improved fuel saving performance as compared with the lubricating oil composition of Comparative Example 5 in which Copolymer (X) was not blended.

The invention claimed is:

1. A lubricating oil composition, comprising:

a base oil; and a copolymer comprising a structural unit derived from a monomer having a (meth) acryloyl group and a linear or branched alkyl group having 6 to 24 carbon atoms, a structural unit derived from a monomer having a (meth) acryloyl group and a polar group, a structural unit derived from a monomer having a (meth) acryloyl group and a cyclic structural group, wherein a content of the structural unit derived from a monomer having a (meth) acryloyl group and a cyclic structural group is in a range of from 7 to 30 mol % based on all structural units of the copolymer, the copolymer has a mass-average molecular weight in a range of 5,000 to 50,000, a content of the copolymer in terms of resin content is in a range of 0.10% by mass to 2.5% by mass based on a total amount of the lubricating oil composition, and the lubricating oil composition has a 100° C. kinematic viscosity of 8.2 $mm^2/s$ or less.

2. The lubricating oil composition according to claim 1, further comprising:

a molybdenum-based friction modifier.

3. The lubricating oil composition according to claim 2, wherein the molybdenum-based friction modifier includes at least one selected from the group consisting of a binuclear molybdenum dithiocarbamate, a trinuclear molybdenum dithiocarbamate, and a molybdenum amine complex.

4. The lubricating oil composition according to claim 3, wherein the binuclear molybdenum dithiocarbamate is a compound of formula (m1), (m1)

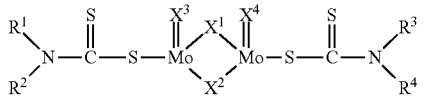

where $R^1$, $R^2$, $R^3$, and $R^4$ are each independently a short-chain substituent group (α) comprising an aliphatic hydrocarbon group having 4 to 12 carbon atoms or a long-chain substituent group (β) comprising an aliphatic hydrocarbon group having 13 to 22 carbon atoms, provided that a molar ratio of the short-chain substituent group (α) to the long-chain substituent group (β) in a total molecule of the compound is in a range of 0.10 to 2.0, and $X^1$, $X^2$, $X^3$, and $X^4$ are each independently an oxygen atom or a sulfur atom.

5. The lubricating oil composition according to claim 2, wherein a content of molybdenum derived from the molybdenum-based friction modifier is in a range of 0.01% by mass to 0.20% by mass based on the total amount of the lubricating oil composition.

6. The lubricating oil composition according to claim 1, further comprising:

a metal-based detergent.

7. The lubricating oil composition according to claim 6, wherein the metal-based detergent includes at least one selected from the group consisting of a calcium-based detergent and a magnesium-based detergent.

8. The lubricating oil composition according to claim 7, wherein the metal-based detergent includes the calcium-based detergent, and a content of calcium derived from the calcium-based detergent is in a range of 0.01% by mass to 0.25% by mass based on the total amount of the lubricating oil composition.

9. The lubricating oil composition according to claim 7, wherein the metal-based detergent includes the magnesium-based detergent, and a content of magnesium derived from the magnesium-based detergent is in a range of 0.01% by mass to 0.20% by mass based on the total amount of the lubricating oil composition.

10. The lubricating oil composition according to claim 1, further comprising:

an ash-free dispersant.

11. The lubricating oil composition according to claim 10, wherein a content of nitrogen derived from the ash-free dispersant is in a range of 0.01% by mass to 0.15% by mass based on the total amount of the lubricating oil composition.

12. The lubricating oil composition according to claim 1, further comprising:

zinc dithiophosphate.

13. The lubricating oil composition according to claim 12, wherein a content of phosphorus derived from the zinc dithiophosphate is in a range of 0.01% by mass to 0.10% by mass based on the total amount of the lubricating oil composition.

14. A method of lubricating an intemal combustion engine, comprising:

applying the lubricating oil composition of claim 1 to the internal combustion engine.

15. A method of lubricating a gasoline engine, comprising:

applying the lubricating oil composition of claim 1 to the gasoline engine.

16. The lubricating oil composition according to claim 1, wherein the 100° C. kinematic viscosity of the lubricating oil composition is in a range of from 5.0 to 6.1 $mm^2/s$.

17. The lubricating oil composition according to claim 3, wherein a content of molybdenum derived from the molybdenum-based friction modifier is in a range of 0.01% by mass to 0.20% by mass based on the total amount of the lubricating oil composition.

18. The lubricating oil composition according to claim 4, wherein a content of molybdenum derived from the molybdenum-based friction modifier is in a range of 0.01% by mass to 0.20% by mass based on the total amount of the lubricating oil composition.

* * * * *